US012421727B1

(12) United States Patent
Stanley

(10) Patent No.: US 12,421,727 B1
(45) Date of Patent: Sep. 23, 2025

(54) SYSTEM AND METHOD FOR MOUNTING ADJUSTABLE ROOF BRACKETS

(71) Applicant: BWDT, LLC, Haltom City, TX (US)

(72) Inventor: Joel A. Stanley, Colleyville, TX (US)

(73) Assignee: BWDT, LLC, Haltom City, TX (US)

( * ) Notice: Subject to any disclaimer, the term of this patent is extended or adjusted under 35 U.S.C. 154(b) by 169 days.

(21) Appl. No.: 17/570,724

(22) Filed: Jan. 7, 2022

Related U.S. Application Data

(60) Provisional application No. 63/241,748, filed on Sep. 8, 2021, provisional application No. 63/137,078, filed on Jan. 13, 2021, provisional application No. 63/134,911, filed on Jan. 7, 2021.

(51) Int. Cl.
*E04D 13/00* (2006.01)
*E04D 13/10* (2006.01)
*E04D 13/12* (2006.01)

(52) U.S. Cl.
CPC ..... *E04D 13/00* (2013.01); *E04D 13/10* (2013.01); *E04D 13/12* (2013.01)

(58) Field of Classification Search
CPC ..... E04D 13/00; E04D 13/10; E04D 13/12
USPC ..... 248/514, 515, 518, 520
See application file for complete search history.

(56) References Cited

U.S. PATENT DOCUMENTS 1,329,478 A * 2/1920 Roche ..... F16G 11/048 403/76
2,557,859 A * 6/1951 Bernstein ..... F21L 4/00 116/63 P
2,628,796 A * 2/1953 Krizman ..... H01Q 1/1221 248/536
2,687,863 A * 8/1954 Vogt ..... H01Q 1/1221 248/536
3,408,780 A * 11/1968 Brister ..... E04D 1/30 248/237
4,778,702 A * 10/1988 Hutter, III ..... B29C 65/7855 156/247
6,240,682 B1 * 6/2001 James ..... E04B 7/024 52/90.2
7,304,614 B2 * 12/2007 Silva ..... H01Q 1/1214 343/711
8,122,648 B1 * 2/2012 Liu ..... F24S 25/61 52/173.3
9,350,289 B1 * 5/2016 Zvanut ..... F24S 25/636
10,839,724 B2 * 11/2020 Torpy ..... F21S 8/08
2011/0260029 A1 * 10/2011 Kost ..... A45B 11/00 224/533
2012/0233958 A1 * 9/2012 Stearns ..... H01Q 1/1221 52/708
2013/0074441 A1 * 3/2013 Stearns ..... E04D 13/10 52/705
2014/0331594 A1 * 11/2014 Stearns ..... F16B 43/001 52/705

(Continued)

FOREIGN PATENT DOCUMENTS

JP 2017145607 A * 8/2017

*Primary Examiner* — Kimberly T Wood
(74) *Attorney, Agent, or Firm* — James E. Walton

(57) ABSTRACT

A system for mounting adjustable roof brackets, the system having a strut mount, a mounting plate, and a membrane covering the mounting plate. The strut mount further includes a base plate and a mounting channel in one embodiment and a base plate, a threaded center post, and at least one longitudinal stiffener in another embodiment.

20 Claims, 34 Drawing Sheets

(56) References Cited

U.S. PATENT DOCUMENTS

| | | | | |
|---|---|---|---|---|
| 2016/0032590 | A1* | 2/2016 | Shevlin | E04D 5/144<br>52/506.05 |
| 2016/0040431 | A1* | 2/2016 | Stanley | F24S 25/61<br>52/741.4 |
| 2017/0107723 | A1* | 4/2017 | Stearns | H02S 30/00 |
| 2020/0224424 | A1* | 7/2020 | Kovacs | E04D 13/10 |
| 2022/0034093 | A1* | 2/2022 | Shadwell | H02S 20/24 |

* cited by examiner

SYSTEM AND METHOD FOR MOUNTING ADJUSTABLE ROOF BRACKETS

This application claims the benefit of U.S. Provisional application Ser. No. 63/134,911, filed 7 Jan. 2021, titled "System and Method for Mounting Adjustable Roof Brackets," U.S. Provisional Application No. 63/137,078, filed 13 Jan. 2021, titled "System and Method for Mounting Adjustable Roof Brackets," and U.S. Provisional Application No. 63/241,748, filed 8 Sep. 2021, titled "System and Method for Mounting Adjustable Roof Brackets," all of which are incorporated by reference herein for all purposes.

BACKGROUND

1. Field of the Present Description

The present application relates to methods and systems for mounting brackets to roof polymeric membranes, and in particular to adjustable and mountable roof brackets.

2. Description of Related Art

Various applications exist in which a polymeric membrane may be placed over a surface. For example, it may be desirable to provide a polymeric membrane as a roofing material. That is, a polymeric membrane may be applied to an outer surface of a building structure, such as a roof, to protect the structure from the environment.

Although great strides have been made in roofing membranes and brackets, considerable shortcomings remain.

DESCRIPTION OF THE DRAWINGS

The novel features believed characteristic of the invention are set forth in the appended claims. However, the invention itself, as well as a preferred mode of use, and further objectives and advantages thereof, will best be understood by reference to the following detailed description when read in conjunction with the accompanying drawings, wherein:

Figure 1A:
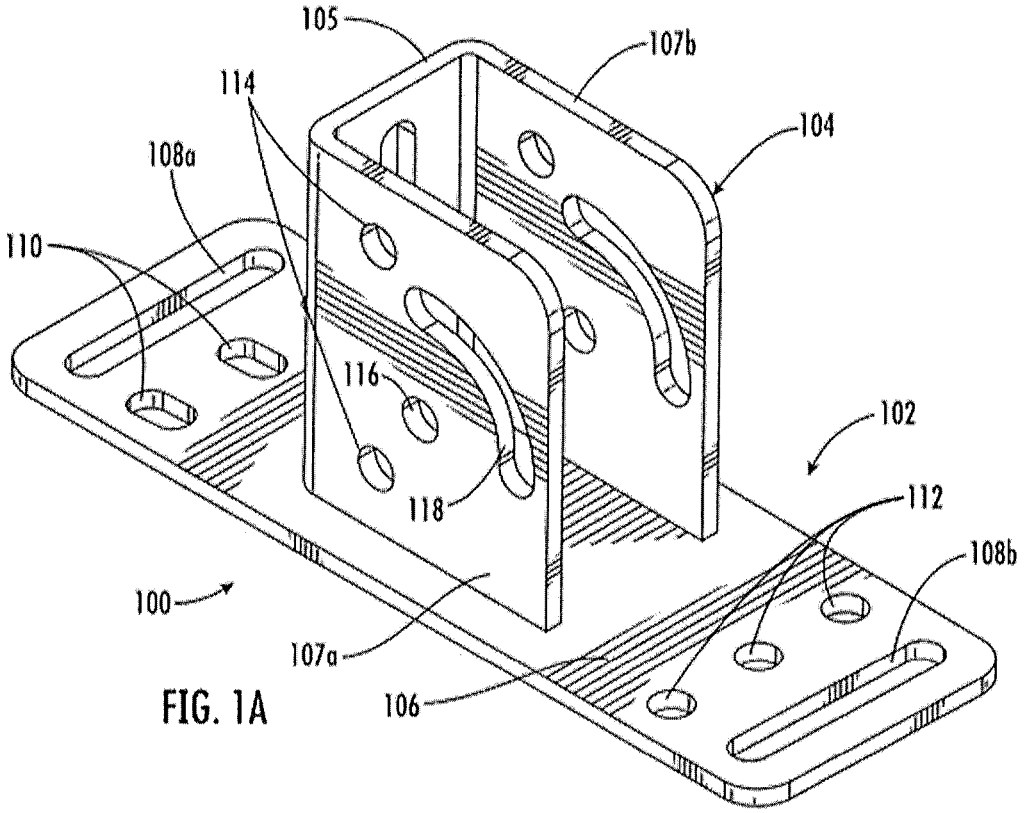
FIG. 1A is a perspective view of one embodiment of an adjustable strut mount which may be used in one or more aspects of the present invention.

While the system and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

For the purposes of promoting an understanding of the principles of the present inventions, reference will now be made to the embodiments, or examples, illustrated in the drawings and specific language will be used to describe the same. It will nevertheless be understood that no limitation of the scope of the invention is thereby intended. Any alterations and further modifications in the described embodiments, and any further applications of the principles of the inventions as described herein are contemplated as would normally occur to one skilled in the art to which the invention relates.

When directions, such as upper, lower, top, bottom, clockwise, counter-clockwise, are discussed in this disclosure, such directions are meant to only supply reference directions for the illustrated figures and for orientation of components in respect to each other or to illustrate the figures. The directions should not be read to imply actual directions used in any resulting invention or actual use. Under no circumstances, should such directions be read to limit or impart any meaning into the claims.

Referring now to FIGS. 1A-1D in the drawings, a preferred embodiment of an adjustable strut mount is illustrated. Adjustable strut mount 100 may be used in one or more aspects of the present invention. The adjustable strut mount 100 includes a base plate 102 coupled to a mount channel 104. Preferably, mount channel 104 projects in a transverse manner away from an upper face 106 of the base plate 102.

In certain embodiments, two transverse slots 108*a* and 108*b* are defined within the base plate 102 and are positioned close to its longitudinal ends. The transverse slots 108*a* and 108*b* allow for various attachment points. A plurality of longitudinally slotted bolt holes are defined within the base plate 102, positioned in proximity to the transverse slot 108*a*. The slotted bolt holes 110 allow for varied bolt spacing in addition to American Standard or metric attachment point spacing. In certain embodiments, a plurality of bolt holes 112 are defined within the base plate 102 and are positioned in proximity to the transverse slot 108*b*. The bolt holes 112 are substantially circular in shape and restrict longitudinal movement of the plate 102. It should be appreciated that alternative embodiments of the base plate 102 may include some, all, or none of transverse slots 108*a*/108*b*, slotted bolt holes 110, and bolt holes 112. Additionally, it should be appreciated that the aforementioned slots and bolt holes may vary in size, shape, and position on base plate 102.

Figure 4B:
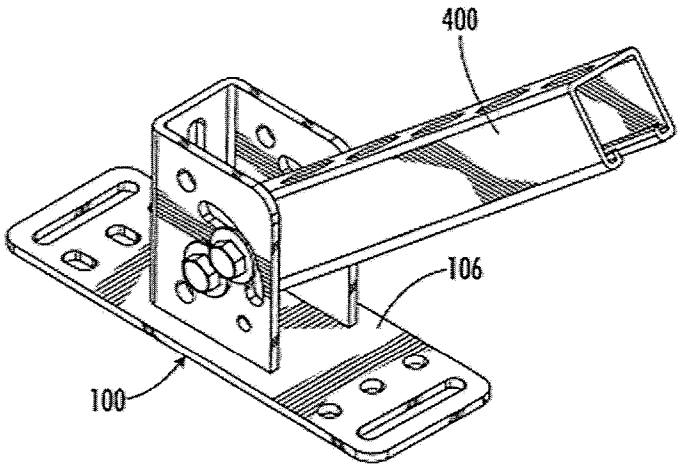
FIG. 4B is a perspective view of the adjustable strut mount of FIG. 1A coupled to the exemplary strut where the strut is in a second angular position.

In certain embodiments, mount channel 104 may have a number of bolt holes for attaching various struts. Additionally, the mount channel may also include a base member or wall 105 and two side members or walls 107*a*-107*b*. Bolt holes 114 may be defined within the side walls 107*a*-107*b* and may be used in conjunction with two throw bolts to attach the adjustable strut mount 100 to a vertical strut 400, as illustrated in FIG. 2B below. In situations where it is desired to mount a strut at an angle, a fulcrum bolt hole 116 and a curved slot 118 are defined within the side walls 107*a*-107*b* and may be used in conjunction with the throw bolts as illustrated in FIG. 4B below.

The adjustable strut mount 100 with the various bolt holes and slots allows for numerous methods of attachments, both to a strut or other support member and to the underlying base or support structure. For instance, in certain embodiments, there may be a vertical slot 120 defined within the base wall 105 of the mount channel 104 as best seen in FIG. 1D. The vertical slot. 120 in conjunction with one or more bolts and strut nuts may be used as an attachment system for coupling a strut 400 to the strut mount 100, as illustrated in FIG. 3C.

Figure 1B:
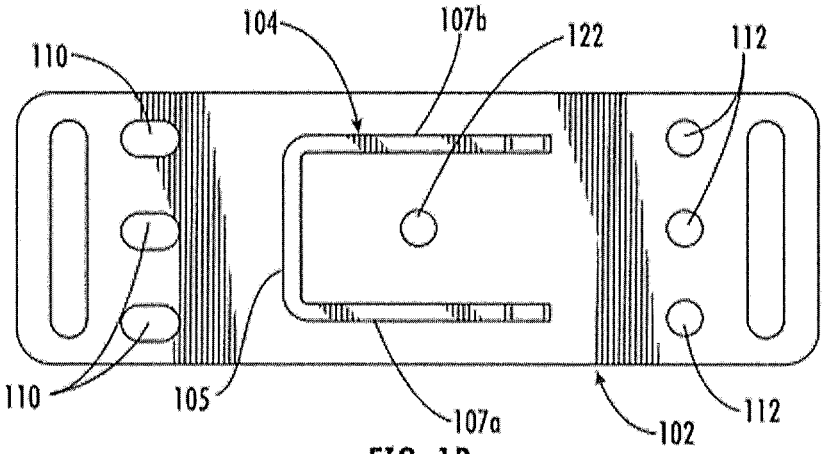
FIG. 1B is a top view of the adjustable strut mount of FIG. 1A.
Figure 1C:
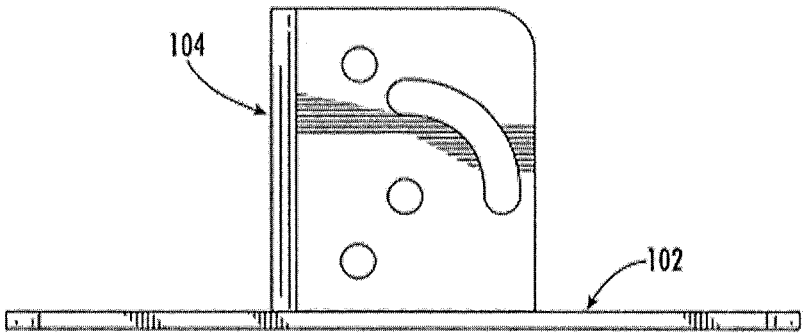
FIG. 1C is a side view of the adjustable strut mount of FIG. 1A.
Figure 1D:
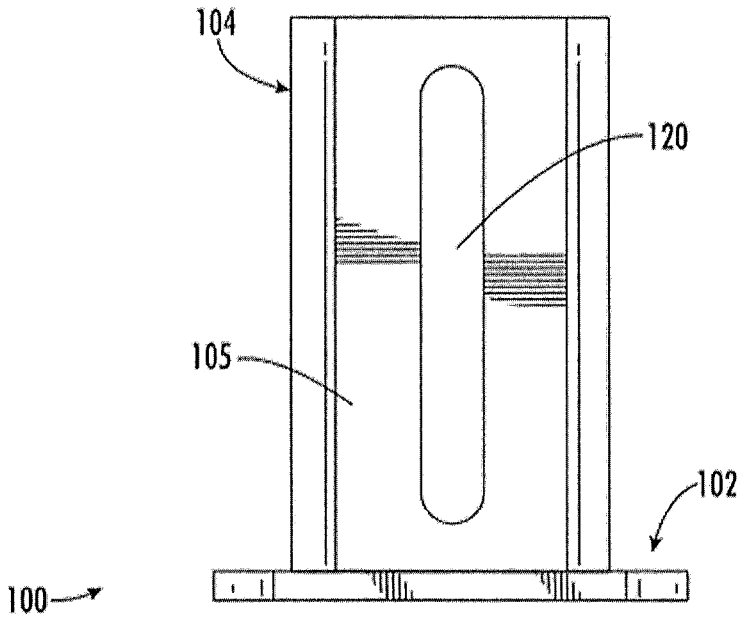
FIG. 1D is a back view of the adjustable strut mount of FIG. 1A.

In certain embodiments, there may also be a center mounting hole 122 as best illustrated in FIG. 1B. The center mounting hole 122 may be used to attach the strut mount 100 to a single anchor base assembly 200 as illustrated in FIGS. 2A and 2B.

Figure 2A:
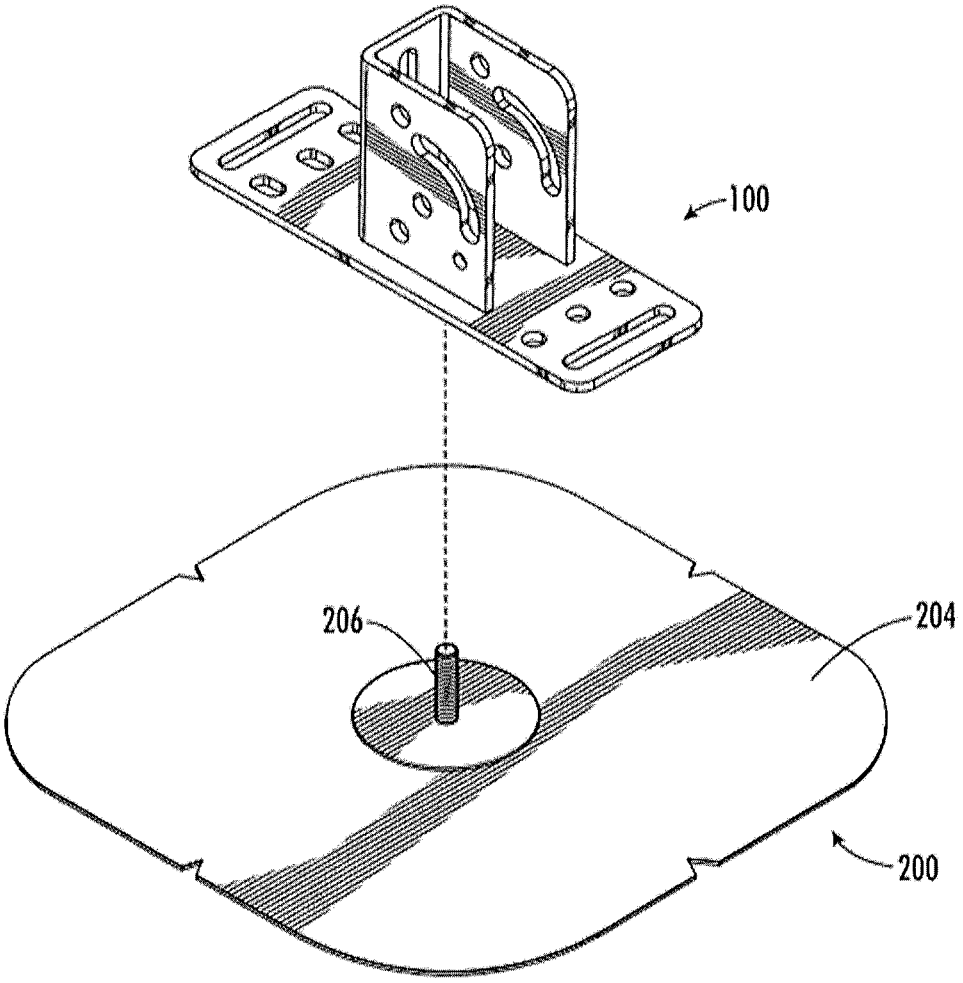
FIG. 2A is an exploded perspective view of the adjustable strut mount of FIG. 1A used with a single anchor base plate and cover membrane.
Figure 2B:
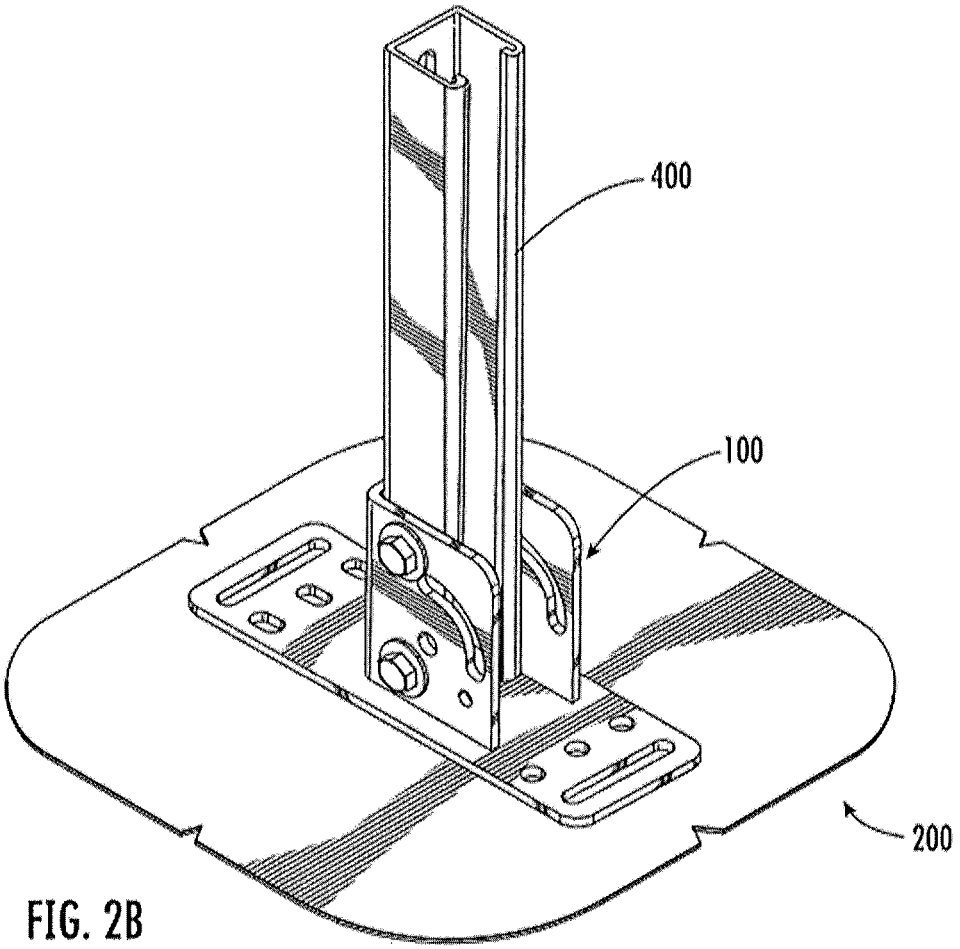
FIG. 2B is a perspective view of the adjustable strut mount of FIG. 1A coupled to the single anchor base plate and cover membrane, and an exemplary strut.

Referring now also to FIG. 2A in the drawings, a strut mount 100 with a single anchor base plate system 200 is illustrated. In certain embodiments, the base system 200 includes a base plate 202 and cover membrane 204. Referring now also to FIG. 2B in the drawings, the strut mount 100 coupled to the single anchor base plate assembly 200 and an exemplary strut 400 is illustrated. In some instances, the cover membrane 204 is a thermoplastic membrane. Example thermoplastic membranes may include one or more of polyvinyl chloride (PVC), thermoplastic olefins (TPO), keytone ethylene esters (KEE), nitrile butadiene polymers (NBP), as well as other thermoplastics. In other instances, thermoset membranes may also be used. For example, thermoset membranes may include membranes formed from ethylene propylene diene monomer (EPDM), as well as any other suitable thermoset membranes, including thermoplastic membranes that may morph into thermoset membranes over time, such as chlorosulfonated polyethylene (CSPE).

In the contemplated embodiment, the cover membrane is preferably secured to a support structure, such as a roof structure. However, it should be appreciated that the system discussed herein could easily be adapted for use with other support structures. Further, in some instances, the mounting plate 202 may be formed entirely or in part from a metal, such as steel, galvanized steel, aluminum, titanium, or other desired or suitable material. Additionally, the mounting plate 202 may or may not be weatherized. In other instances, the mounting plate 202 may be formed from other materials, such as glass, plastic, ceramics, composite materials, or any other material. It should be appreciated that some applications may not require polymeric membrane. In such instances, the mounting plate may be bonded or attached directly to structure without the use of a membrane.

In certain embodiments, the mounting plate 202 may have one or more protrusions, such as center protrusion 206 extending therefrom that may be used for securing the strut mount 100 to the mounting plate. For example, in some instances, the protrusion 206 may provide for a threaded exterior, although any other suitable connection mechanism may be used. In this example, the center protrusion 206 is threaded and sized to extend through the center mounting hole 122 of the strut mount 100 discussed above. A nut may then be used to secure the strut mount 100 to the mounting plate. The center protrusion 206 may allow attachment and detachment of the strut mount without damage or alteration to the polymeric membrane 204. Still, in other implementations, the mounting plate may omit the center protrusion 206.

Figure 3A:
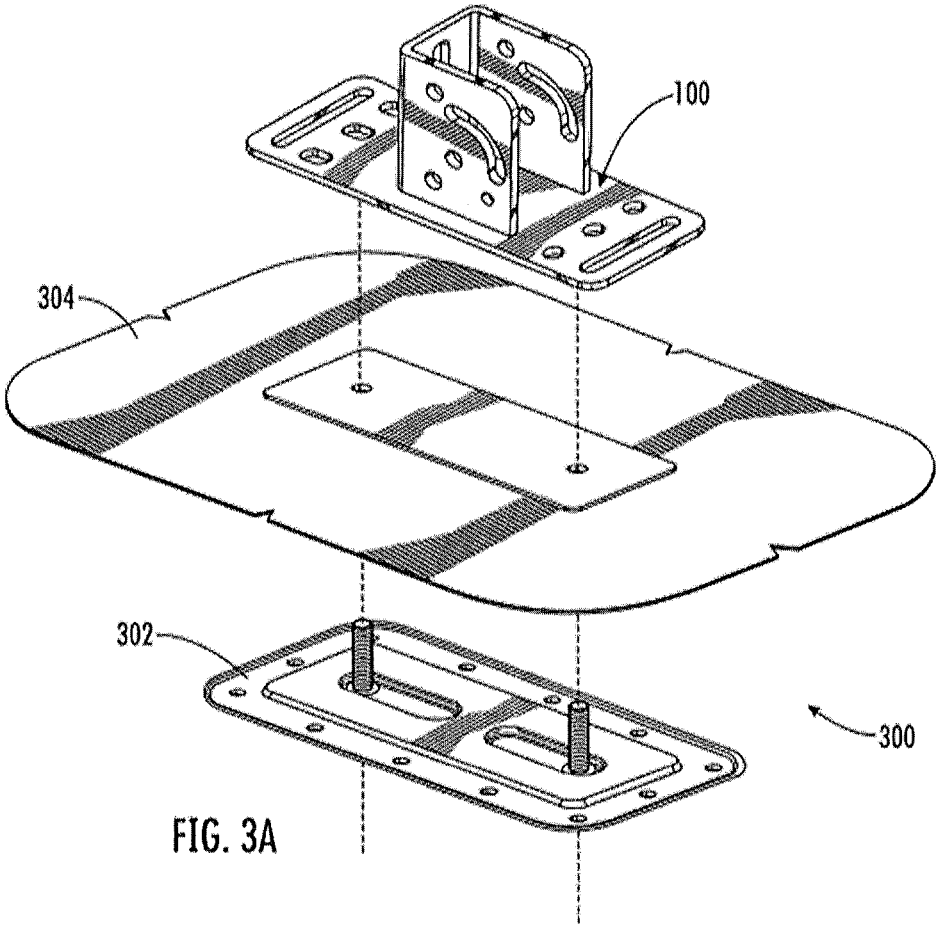
FIG. 3A is an exploded perspective view of the adjustable strut mount of FIG. 1A used with a duel anchor base plate and cover membrane.
Figure 3B:
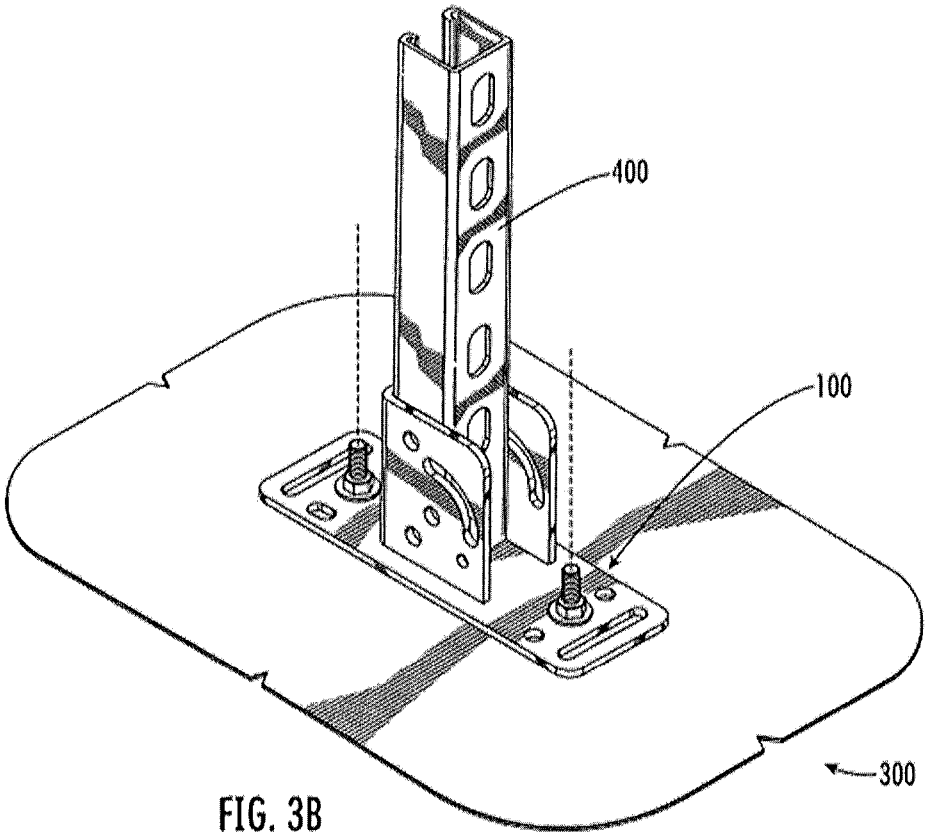
FIG. 3B is a perspective view of the adjustable strut mount of FIG. 1A coupled to the dual anchor base plate and cover membrane, and an exemplary strut.
Figure 3C:
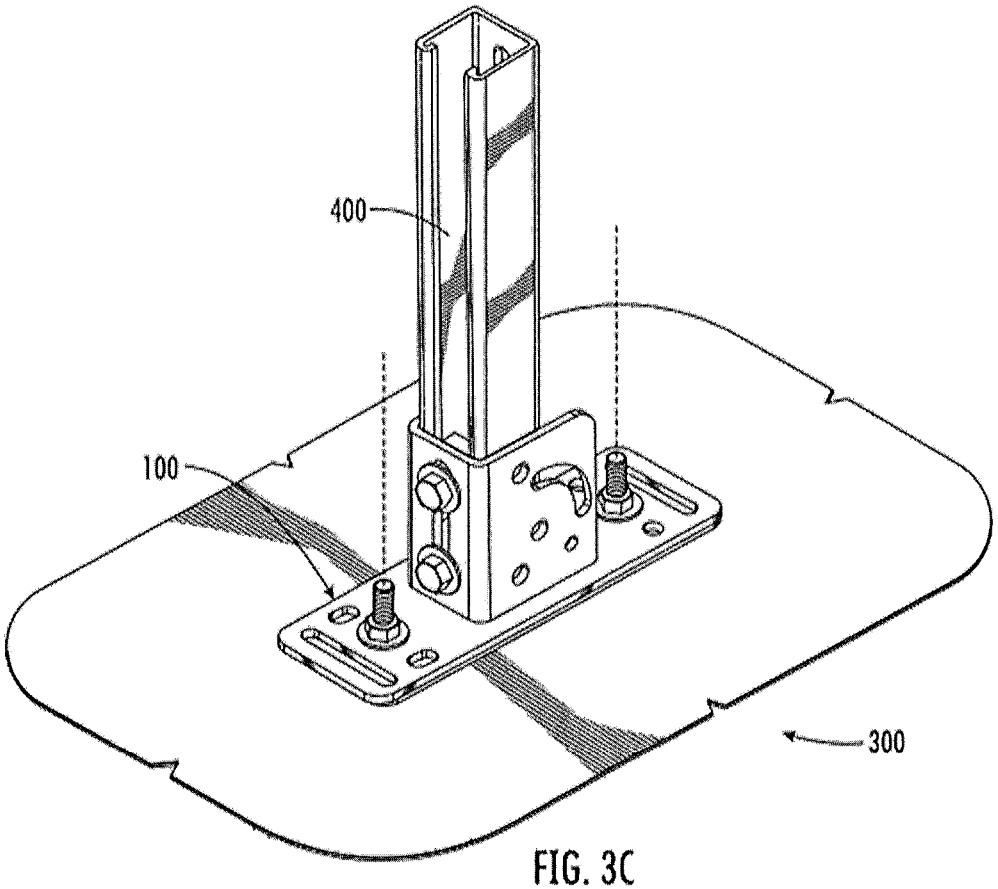
FIG. 3C is the assembly of FIG. 3B, but illustrated from an opposing angle.

Referring now also to FIGS. 3A-3C in the drawings, a dual anchor assembly 300 is illustrated. FIG. 3A shows an exploded view of dual anchor assembly 300 including adjustable strut mount 100 with a dual anchor base plate 302 and cover membrane 304. FIGS. 3B and 3C illustrate the assembled embodiment of dual anchor assembly 300. The dual anchor assembly 300 is similar to the single anchor base plate assembly 200 discussed above except that it uses two anchors and consequently does not use the center mounting hole 122 discussed above. Instead, the strut mount 100 may be coupled to the dual anchor base plate 302 by use of one of the slotted holes 110 and one of the circular holes 112 as illustrated in FIGS. 3B and 3C. For brevity and clarity, a description of those parts which are identical or similar to those described in connection with the single anchor system illustrated in FIGS. 2A and 2B will not be repeated here. Reference should be made to the foregoing paragraphs with the following description to arrive at a complete understanding of the dual anchor assembly 300.

While FIGS. 3A-3C best illustrate an embodiment of a dual anchor assembly with two anchors, it should be appreciated that alternative embodiments may further include additional anchor points. For example, the assembly could be a square shape with four anchor points, rather than a rectangle with two anchor points. It should be appreciated that any number of anchor points, placed on various shaped assemblies, can be used, without deviating from the invention presented herein. The shapes illustrated are simply a few examples of potential configurations.

Figure 4A:
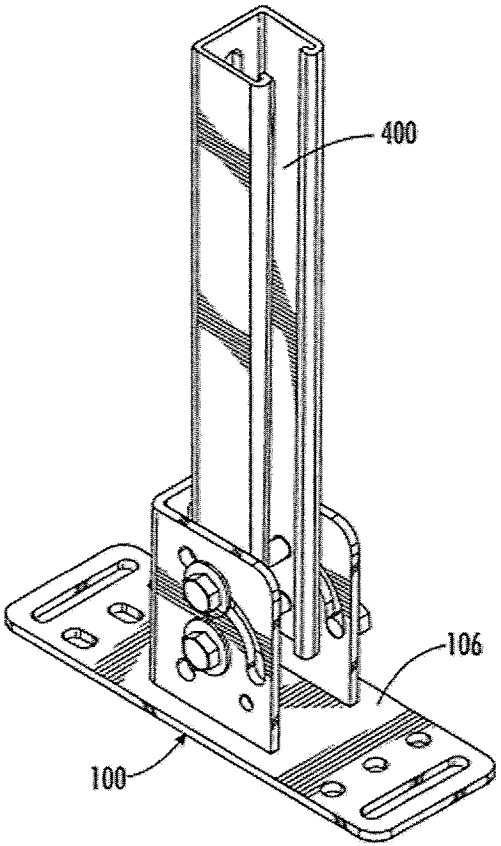
FIG. 4A is a perspective view of the adjustable strut mount of FIG. 1A coupled to an exemplary strut where the strut is in a first angular position.

Referring now also to FIGS. 4A-4B in the drawings, an adjustable strut mount in illustrated. FIG. 4A shows adjustable strut mount 100 coupled to an exemplary strut 400 where the strut 400 is in a first angular position, such as 90 degrees with respect to the base plate 102. FIG. 4B shows the same strut mount as FIG. 4A, but with strut 400 in a second angular position. In this embodiment, the exemplary strut 400 can be adjusted from a position that is substantially parallel to the base plate 102 to a position where the strut 400 is substantially 90 degrees with respect to the base plate 106.

Figure 5:
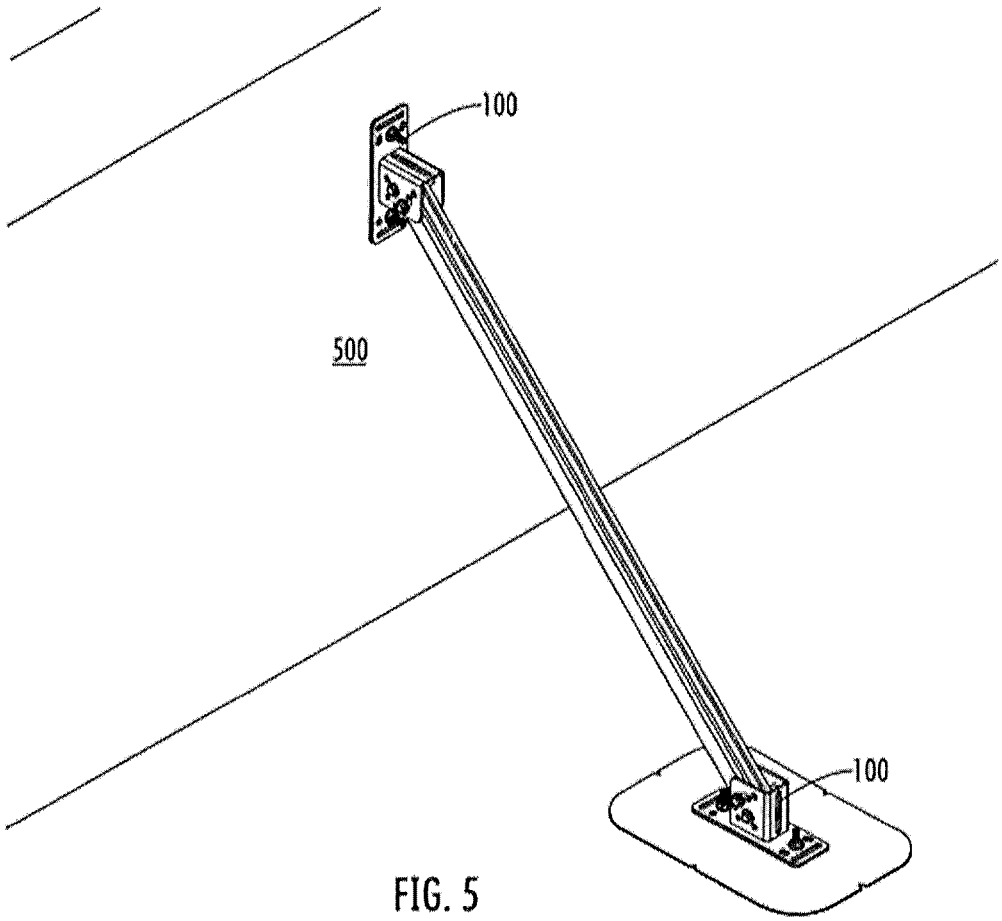
FIG. 5 is a perspective view of an exemplary wall support system showing the use of two adjustable strut mounts, where one of the strut mounts is attached directly to the wall.

In certain embodiments, the strut mount may be coupled to a structure, such as a wall without the use of an underlying mounting plate and/or membrane. Referring now also to FIG. 5 in the drawings, an example of these embodiments is shown. FIG. 5 shows an exemplary wall support system using two adjustable strut mounts 100, where one of the strut mounts is attached directly to a wall 500.

Figure 6A:
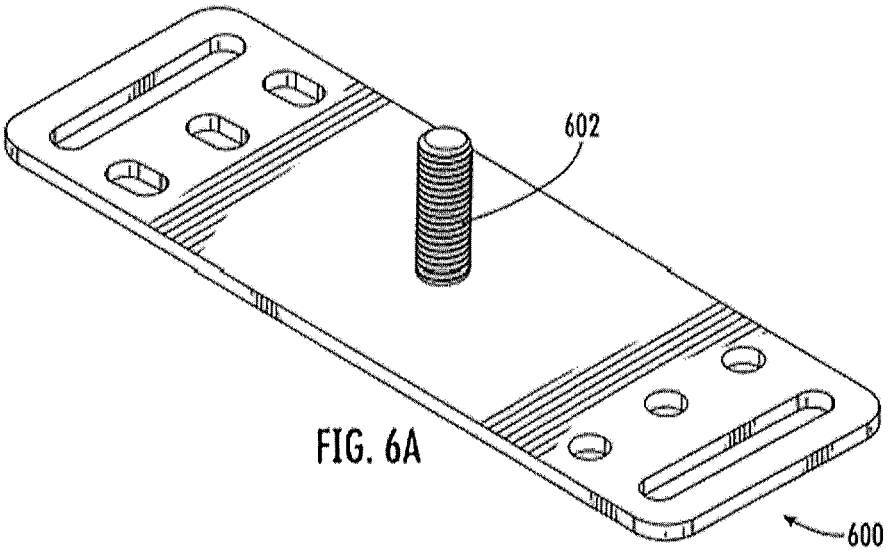
FIG. 6A is a perspective view of one embodiment of a support mount which may be used in one or more aspects of the present invention.
Figure 6B:
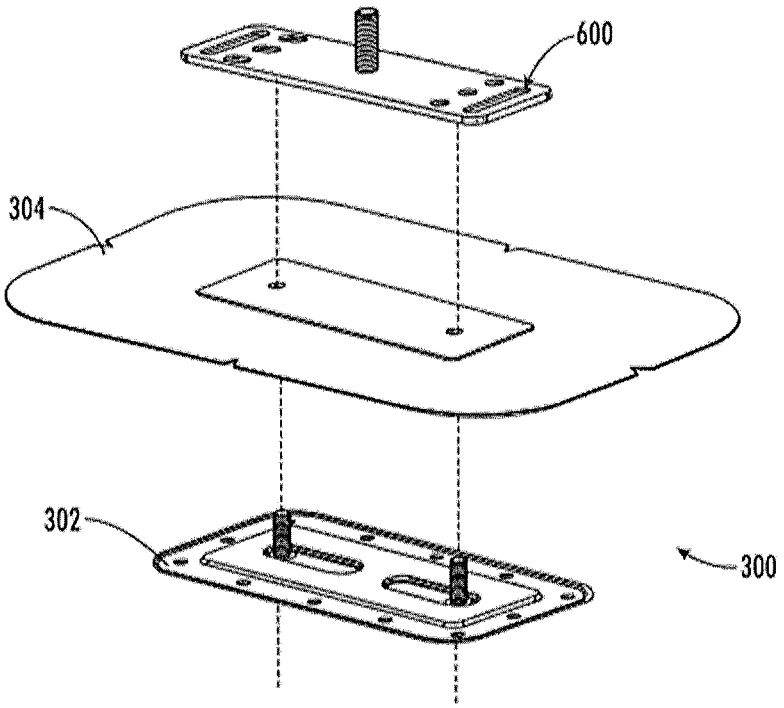
FIG. 6B is an exploded perspective view of the support mount of FIG. 6A used with a dual anchor base plate and cover membrane.
Figure 6C:
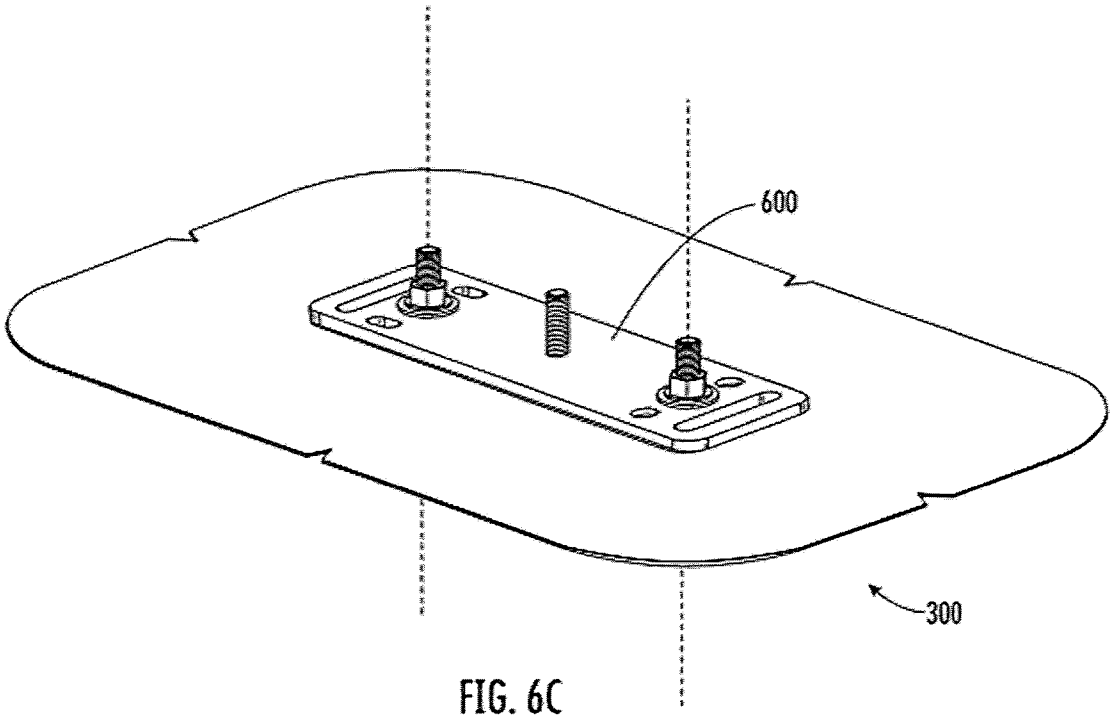
FIG. 6C is a perspective view of the support mount of FIG. 6A coupled to the dual anchor base plate and cover membrane.

Referring now also to FIGS. 6A-6C in the drawings, an alternative embodiment of a support mount is illustrated. Support mount 600 is similar to the strut mount 100 discussed above, except that mount channel 104 has been replaced with a threaded center protrusion 602. The threaded center protrusion 602 may be used to attach the support mount 600 to a wide variety of equipment having anchor holes defined within the support structure. For brevity and clarity, a description of those parts which are identical or similar to those described in connection with the strut mount 100 of FIGS. 1A-1D will not be repeated here. Reference should be made to the foregoing paragraphs with the following description to arrive at a complete understanding of the support mount 600.

FIG. 6B illustrates an exploded view support mount 600 used with a dual anchor base plate 302 and cover membrane 304, such as in the dual anchor base plate assembly 300 discussed above. FIG. 6C illustrates the support mount 600 coupled to the dual anchor base plate assembly 300 via the use of bolts and washers.

Figure 7A:
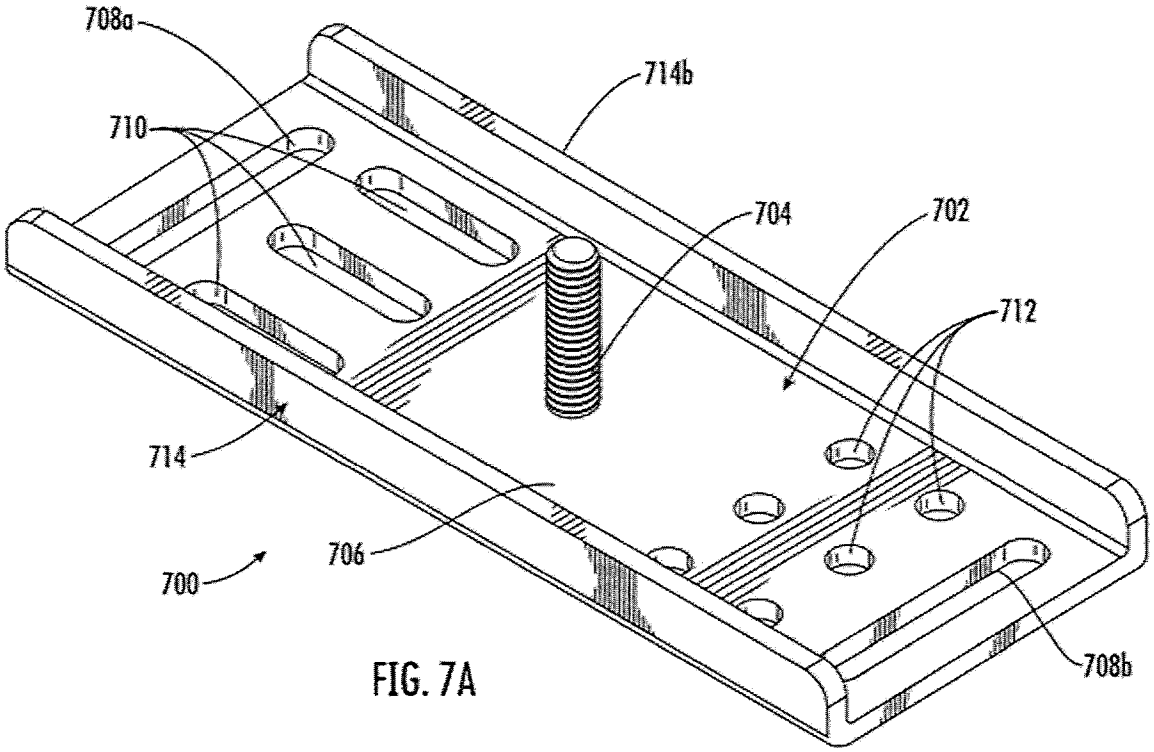
FIG. 7A is a perspective view of another embodiment of a support mount which may be used in one or more aspects of the present invention.
Figure 7B:
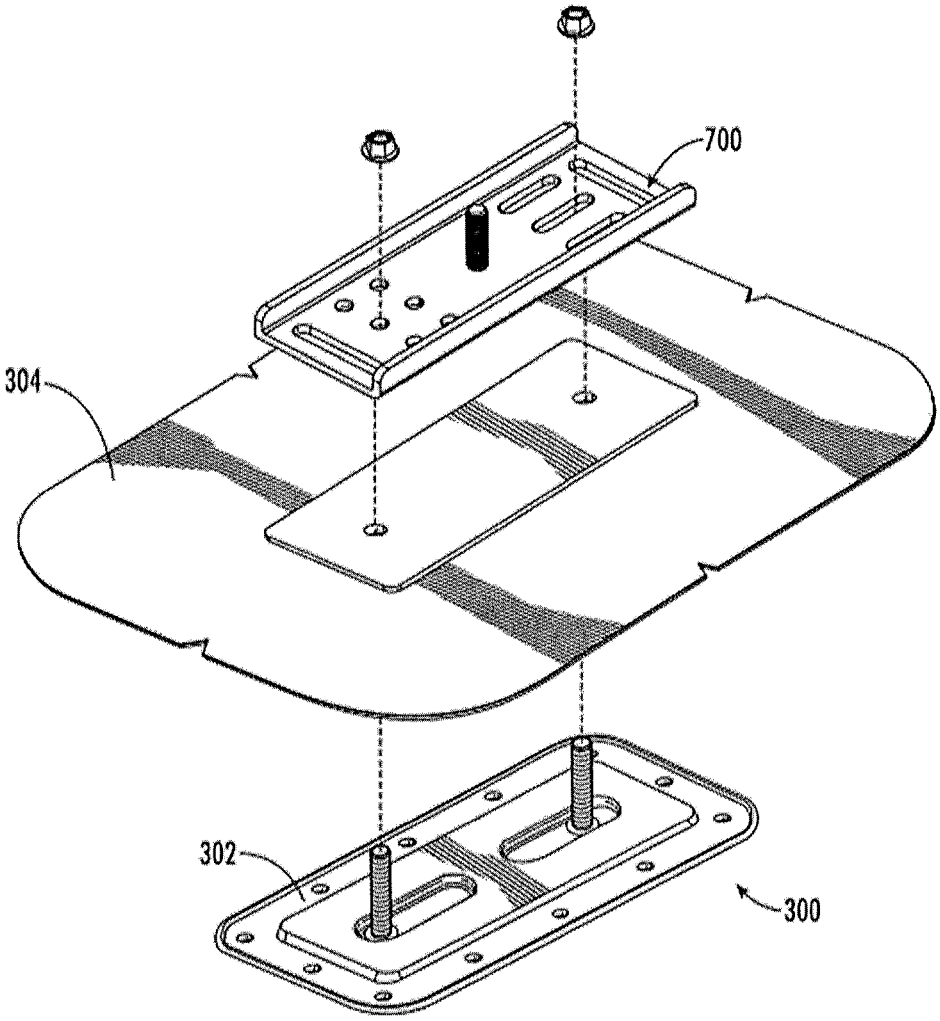
FIG. 7B is an exploded perspective view of the support mount of FIG. 7A used with a dual anchor base plate and cover membrane.
Figure 7C:
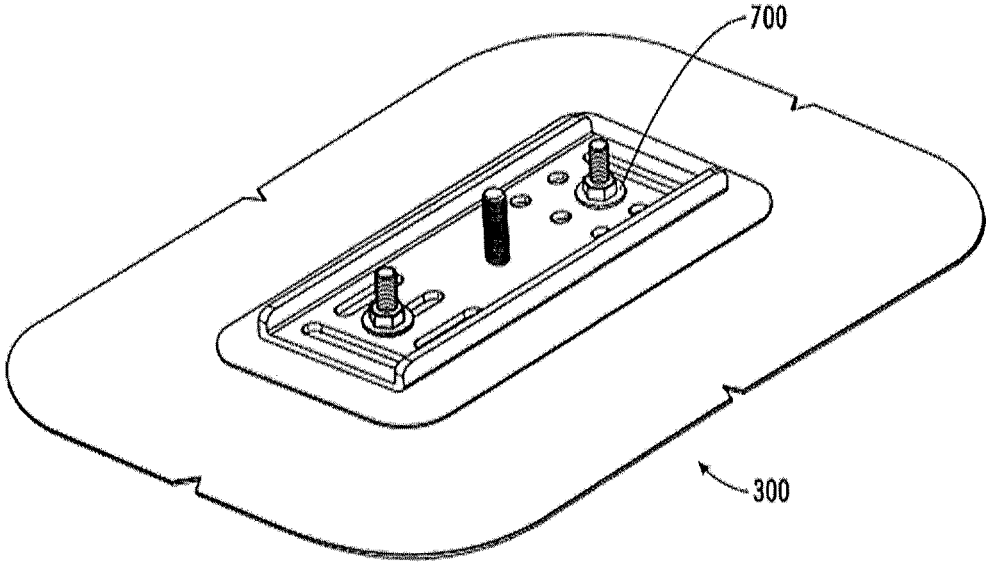
FIG. 7C is a perspective view of the support mount of FIG. 7A coupled to the dual anchor base plate and cover membrane.

Referring now also to FIGS. 7A-7C in the drawings, an alternative embodiment of a support mount is illustrated. Support mount 700 is similar to the mounts 100 and 600 discussed above. Support mount 700 includes a base plate 702 coupled to a center protrusion 704 which projects in a transverse manner away form an upper face 706 of the base plate 702. In certain embodiments, male exterior threads are defined on the center protrusion 704 so that the center protrusion can engage and mate with corresponding female threads of a bolt or other attachment mechanism. The center protrusion 704 may be used to attach the support mount 700 to a wide variety of equipment having anchor holes defined within the support structure.

In certain embodiments, two transverse end slots 708*a* and 708*b* are defined within the base plate 702 and are positioned close to its longitudinal ends. The transverse slots 708*a*-708*b* allow for various attachment points. A plurality of longitudinally slotted bolt holes 701 are defined within the base plate 702 positioned in proximity to the transverse slot 708*a*. The slotted bolt holes 710 allow for varied bolt spacing in addition to American Standard or metric attachment point spacing.

In certain embodiments, a plurality of bolt holes 712 are defined within the base plate 702 and may be positioned in proximity to the transverse end slot 708*b*. The bolt holes 712 are substantially circular in shape and restrict longitudinal movement of the plate 702. The strut mount 700 with the various bolt holes and slots allows for numerous methods of attachments both to a strut or other support member and to the underlying base or support structure.

In certain embodiments, there may be one or more longitudinal stiffeners or legs, such as stiffeners 714*a* and 714*b*. In certain embodiments, the stiffeners 714*a* and 714*b* may be turned up ends to form a shallow channel shape in cross-section. In certain embodiments, the channel shape may be formed by a hot rolling process or a cold press process as is known in the art. In yet other embodiments, one or more longitudinal stiffeners may be welded to the upper surface 706 of the base plate 702. Applying longitudinal stiffeners increases the moment of inertia of the cross section of the base plate 702, which in turn increases the stiffness of the support mount 700 over a flat plate support mount, such as support mount 600 discussed above. In the preferred embodiment, the upturned stiffeners 714*a* and 714*b* are not vertical, but rather angled outward at an angle down from the vertical, preferably of about 60°. This allows brackets, such as the bracket of FIG. 12C, to rotate about protrusion 704 relative to strut mount 700.

FIG. 7B illustrates an exploded view of support mount 700 used with a dual anchor base plate 302 and cover membrane 304, such as in the dual anchor assembly 300 discussed above. FIG. 7C illustrates the support mount 700 couped to the dual anchor base plate assembly 300 via the use of bolts and washers.

Figure 8A:
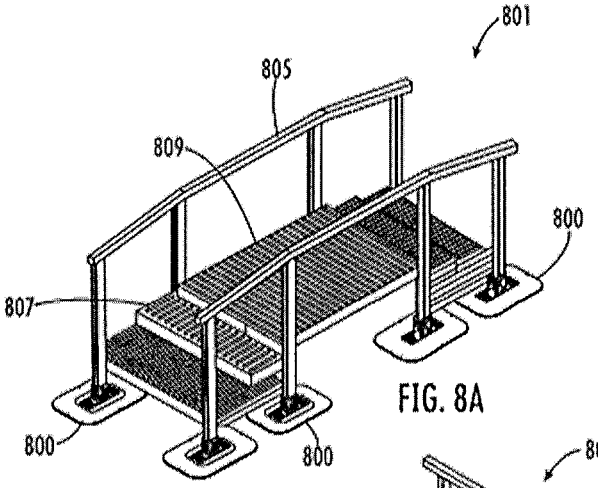
FIG. 8A is a perspective view of a plurality of support mounts used to secure a crossover.
Figure 8B:
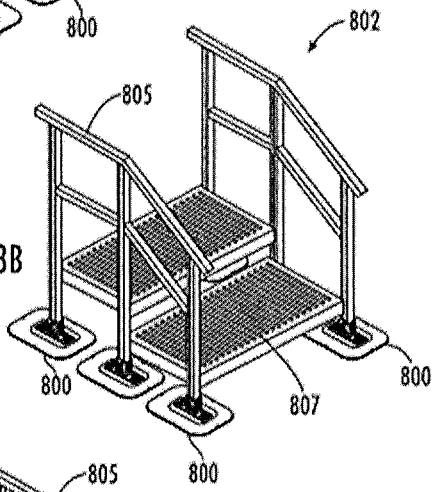
FIG. 8B is a perspective view of a plurality of support mounts used to secure a stairway.
Figure 8C:
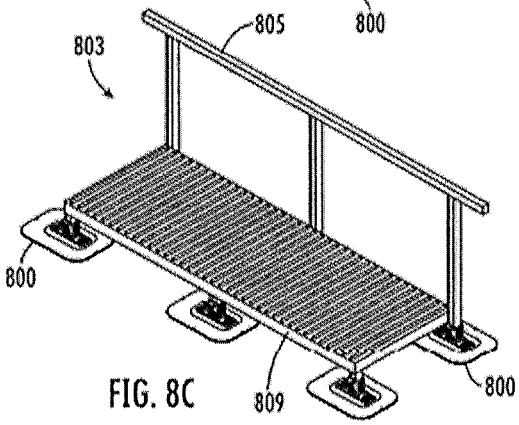
FIG. 8C is a perspective view a plurality of support mounts used to secure a walkway.

Referring now also to FIGS. 8A-8C in the drawings, various structural applications of support mounts are illustrated. The structural applications shown are configured to allow a safe means of access and egress with a variety of options, such as secured stairs, crossover bridges, roof walkway, and other various options.

FIG. 8A illustrates a crossover. Crossover 801 can be used on various places such as rooftops of structures. Crossover 801 includes steps 807, railing 805, walking surface 809, and support mounts 800. Support mounts 800 are similar to dual anchor assembly 300. However, it should be appreciated that various support mounts encompassed by this application may be used to mount crossover 801.

FIG. 8B illustrates a staircase. Staircase 802 is configured for attachment on the rooftop of a structure; however, it could be used in other various locations. Staircase 802 preferably includes support mounts 800, steps 807, and railing 805.

FIG. 8C best illustrates a walkway for attachment on a roof or other similar structure. Walkway 803 preferably includes support mounts 800, walking surface 809, and railing 805. It should be appreciated that the structures illustrated in FIGS. 8A-8C are exemplary, and that the structures may take on various size and shape, while maintaining the use of the support mounts claimed in this application.

Figure 9:
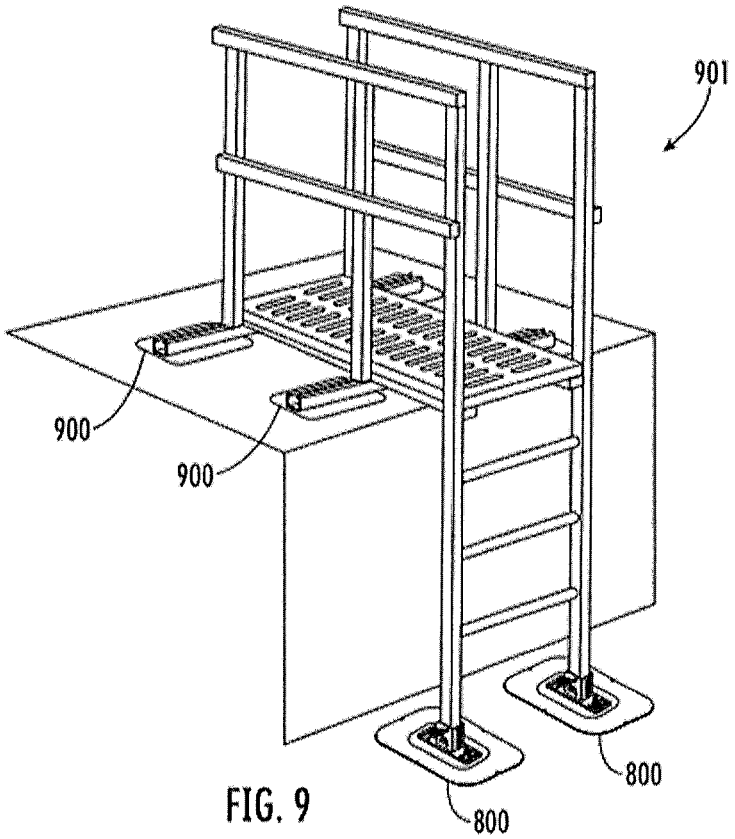
FIG. 9 is a perspective view of a plurality of support mounts used to secure a roof ladder.

Referring now also to FIG. 9 in the drawings, a roof ladder is illustrated. Roof ladder 901 is configured to provide a secure mounting solution to various rooftop access systems. Roof ladder 901 can be custom configured to include various designs and attachments. However, roof ladder 901 preferably includes the use at least one of support mount 800 or support mount 900. In this embodiment, support mount 800 is configured similar to dual anchor assembly 300, while support mount 900 is configured similar to single anchor assembly 200. It should be appreciated that a roof ladder configuration may use one of, or both of, these support mounts in various combinations, depending on the specific design needs of each individual roof system.

Figure 10:
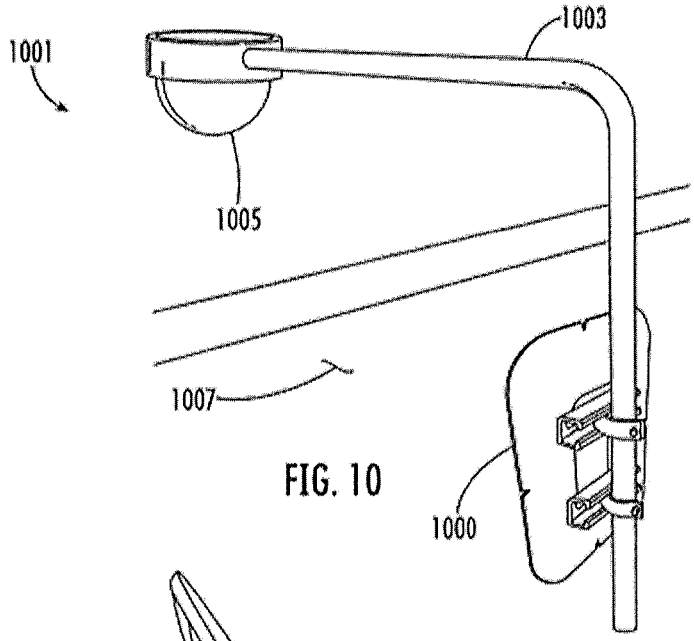
FIG. 10 is a perspective view of a support mount used to mount a camera system.

Referring now also to FIG. 10 in the drawings, a camera mounting system is illustrated. Camera system 1001 preferably includes support mount 1000, camera support 1003, and camera 1005. In this embodiment, support mount 1000 secures camera system 1001 to wall 1007. However, it should be appreciated that other systems may take on various configurations, such as mounting the camera system to a rooftop surface, rather than a wall surface. In this embodiment, support mount 1000 is similar to dual anchor assembly 300, except a different bracket is used to secure camera support 1003. It should be appreciated that various bracket configurations may be used on a dual anchor assembly, depending on the design of the element being attached to the support mount.

Figure 11A:
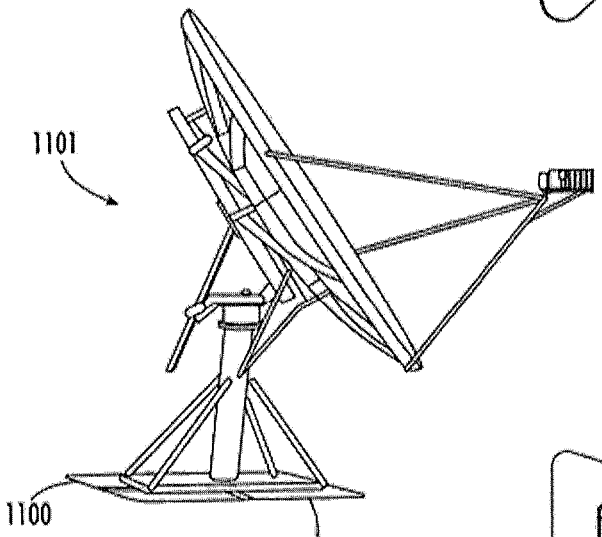
FIG. 11A is a perspective view of a plurality of support mounts used to secure a satellite system.
Figure 11B:
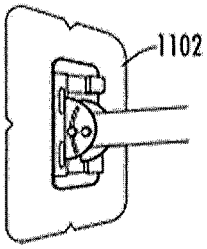
FIG. 11B is a perspective view of a wall support mount which can be used to secure the satellite system of FIG. 11A to a wall.

Referring now also to FIGS. 11A and 11B, a satellite securement system is illustrated. The satellite securement system illustrated provides a stable and secure option for a system that meets ASCE-7 regulations for a commercial roof. FIG. 11A best illustrates a satellite system 1101 secured to a rooftop surface using support mounts 1100. Support mounts 1100 may be similar to single anchor assembly 200 or dual anchor assembly 300, depending on the desired connection to the satellite system. FIG. 11B best illustrates an alternative mounting of the satellite system of FIG. 11A. In this alternative embodiment, a support mount 1102 is shown as a mount for a satellite system, the support mount 1102 being mounted to a wall, rather than a rooftop surface. In this embodiment, support mount 1102 is similar to the dual anchor assembly 300.

Figure 12A:
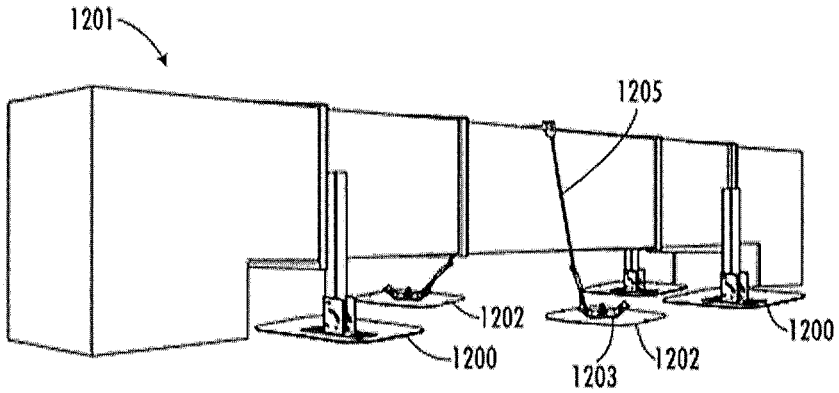
FIG. 12A is a perspective view of a plurality of support mounts used to secure a duct system.
Figure 12B:
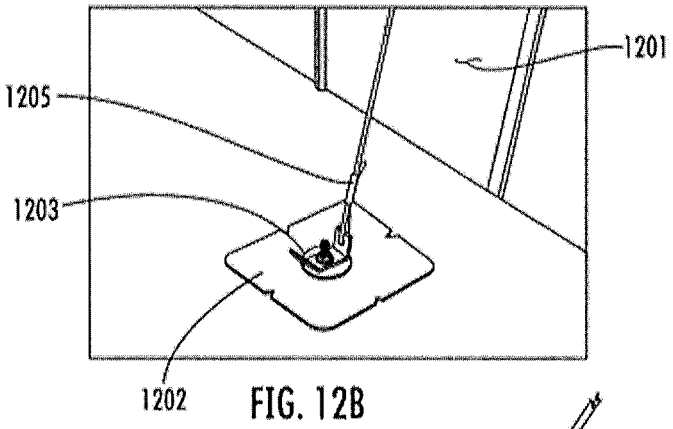
FIG. 12B is an enlarged perspective view of a support mount of FIG. 12A used as a tie down for the duct system.
Figure 12C:
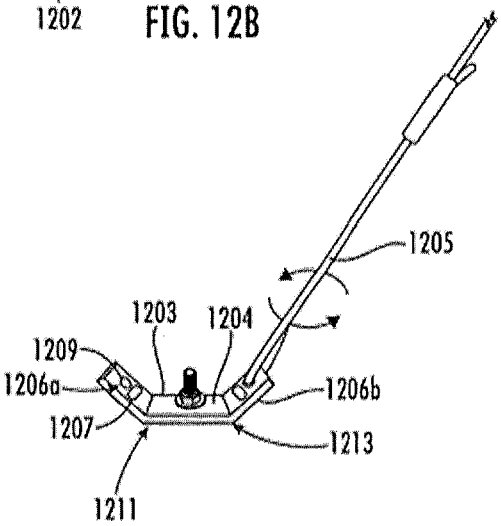
FIG. 12C is an enlarged perspective view of the duct tie down of FIG. 12B.

Referring now also to FIGS. 12A-12C, a duct securement system is illustrated. The duct securement system embodiments illustrated provide an effective and reliable attachment for a new or existing duct system, securing it in place under the harshest conditions. FIG. 12A best illustrates a duct system 1201, the duct system being secured to a structure using support mounts 1200, support mounts 1202, and guy wire 1205. Support mounts 1202 include a bracket 1203, which is best illustrated in FIG. 12C. It should be appreciated that various support mounts may be used in different locations, depending on where the securement points of the duct system are.

FIG. 12B best illustrates an enlarged view of support mount 1202, used to secure duct system 1201. FIG. 12C best illustrates an enlarged view of the bracket 1203 used in securing the duct system. Bracket 1203 includes a first angle 1211 and a second angle 1213, both of which are approximately 30 degrees. Additionally, bracket 1203 includes a center portion 1204 and two side portions 1206*a* and 1206*b*. First angle 1211 is the angle between center portion 1204 and side potion 1206*a*. Second angle 1213 is the angle between center potion 1204 and side portion 1206*b*. Each side portion 1206*a*-1206*b* preferably includes an optional slotted hole 1207 and a hole 1209. Slotted hole 1207 and hole 1209 are configured for attaching various devices to the bracket 1203, such as a guy wire or a fastening strap.

Bracket 1203 may have only one upturned side portion 1206*a*. When bracket 1203 is used with support mount 700 of FIG. 7A, particularly with the preferred embodiment of support mount 700 which has outwardly angled stiffeners, bracket 1203 may rotate within support mount 700. This adjustable rotation allows the load path between bracket 1203 and the guy wire to straightened and maximized.

Figure 13A:
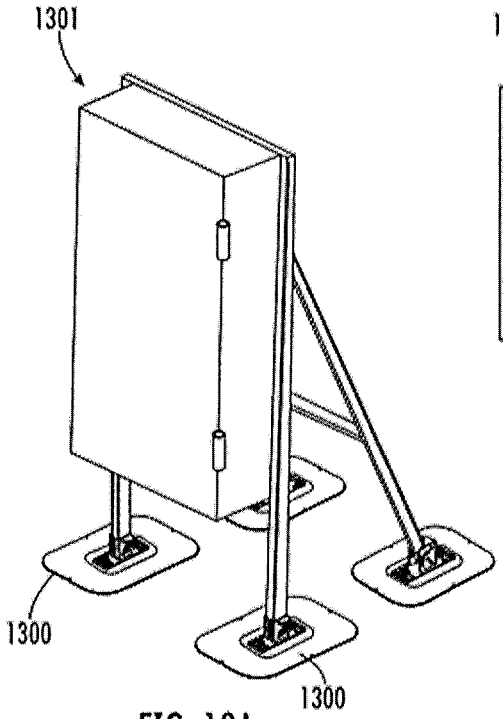
FIG. 13A is a perspective view of a plurality of support mounts used to mount an electrical box.
Figure 13B:
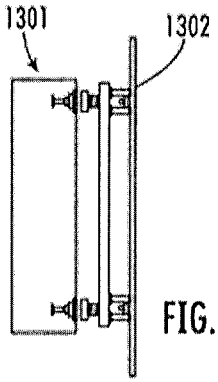
FIG. 13B is a side view of a plurality of support mounts used to mount an electrical box to a wall.

Referring now also to FIGS. 13A and 13B in the drawings, an electrical box mounting system is illustrated. In FIG. 13A, electrical box 1301 is configured to be attached to a structure, such as a roof, using support mounts 1300. In this embodiment, support mounts 1300 are similar to the dual anchor assembly 300. FIG. 13B best illustrates an alternative embodiment of electrical box 1301, wherein the electrical box is mounted to a wall, or similar structure, using support mount 1302. It should be appreciated that the electrical boxes illustrated here are exemplary, and that variations of electrical boxes may be used in similar configurations with support mounts 1300 and 1302. The electrical box mounting system shown here provides strength to hold down electrical boxes on a roof, or other similar structure, as well as preventing movement that can lead to roof leaks and damage to electrical components.

Figure 14:
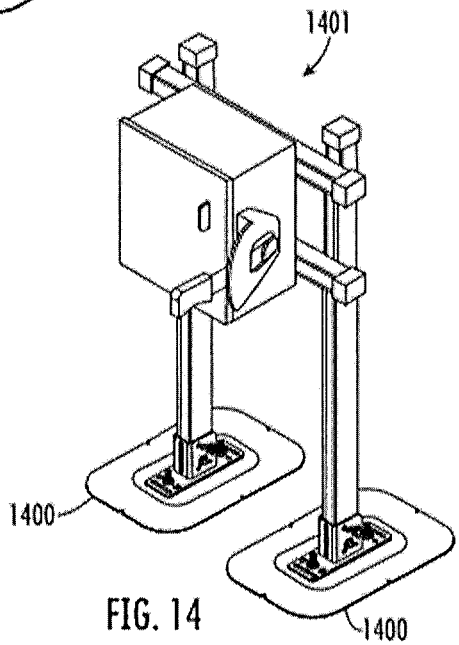
FIG. 14 is a perspective view of a plurality of support mounts used to secure an electrical disconnect box.

Referring now also to FIG. 14 in the drawings, an electrical disconnect box securement system is illustrated. Electrical disconnect box 1401 is configured to be secured to a structure, such as a roof, using support mounts 1400. Support mounts 400 are similar to the dual anchor assembly 300. It should be appreciated that variations of the electrical disconnect box 1401 may be used in a disconnect box securement system. The electrical disconnect box 1401, illustrated here, is exemplary. The electrical disconnect box securement system helps to prevent damage and unnecessary maintenance expenses caused by wind or other seismic events.

Figure 15:
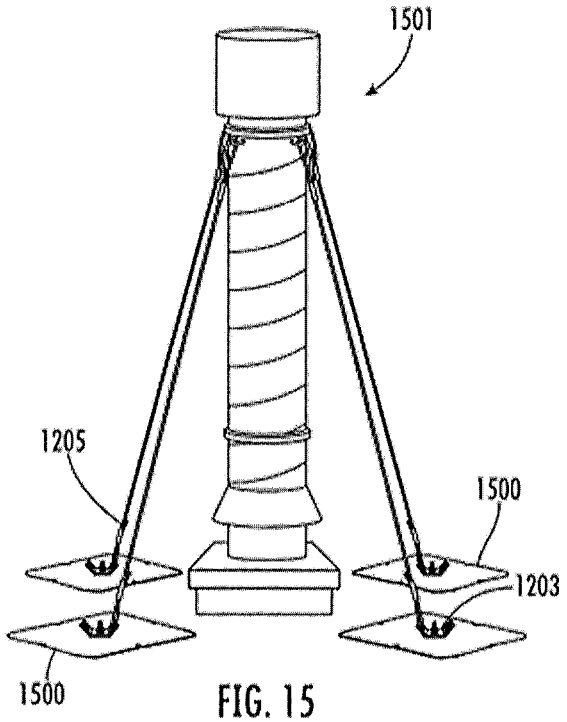
FIG. 15 is a perspective view of a plurality of support mounts used to secure an exhaust system.

Referring now also to FIG. 15 in the drawings, an exhaust securement system is illustrated. Exhaust system 1501 is secured to a structure, such as a roof, using support mounts 1500. Support mounts 1500 are similar to single anchor assembly 200. The exhaust system 1501 is attached to support mounts using brackets 1203 and guy wire 1205, similar to the duct securement system of FIGS. 12A-12C. It should be appreciated that various exhaust systems can be secured using the support mounts illustrated here, and that other embodiments and numbers of support mounts may be used. The exhaust securement system presented here is securely mounted, so as to lead the way in exceeding building codes, as well as the unique standards for exhaust systems.

Figure 16:
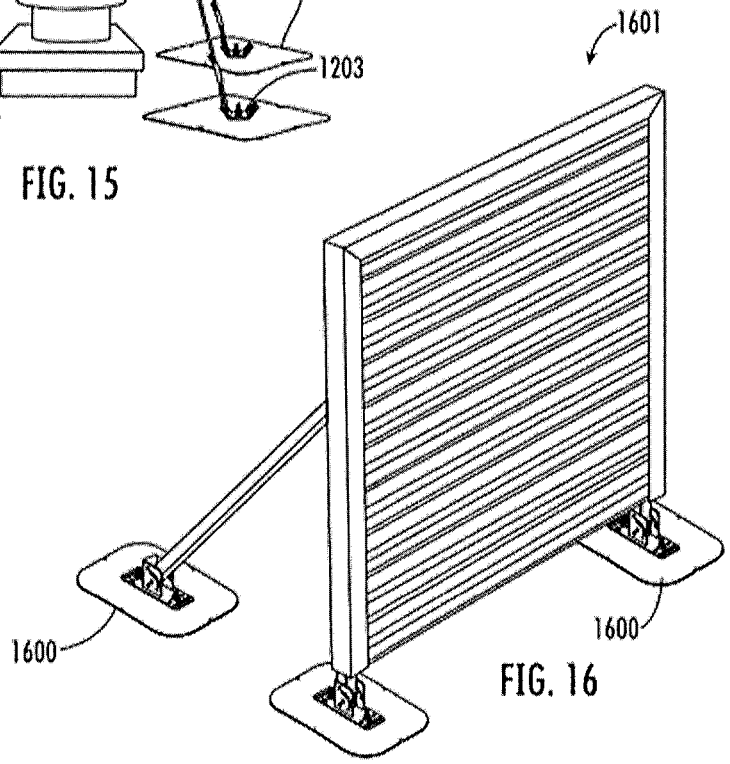
FIG. 16 is a perspective view of a plurality of support mounts used to secure an equipment screen.

Referring now also to FIG. 16 in the drawings, an equipment screen is illustrated. Equipment screen 1601 is configured for securement to a structure, such as a roof, using support mounts 1600. In this embodiment, support mounts 1600 are similar to the dual anchor system 300. It should be appreciated that the equipment screen illustrated here is exemplary, and that other configurations of equipment screens may be used along with support mounts 1600 for securement to a structure. The equipment screen presented here is a solution that is preferably utilized on commercial roofs so as to conceal unsightly rooftop equipment and to reduce equipment noise and wind effects on equipment and other roof assemblies.

Figure 17:
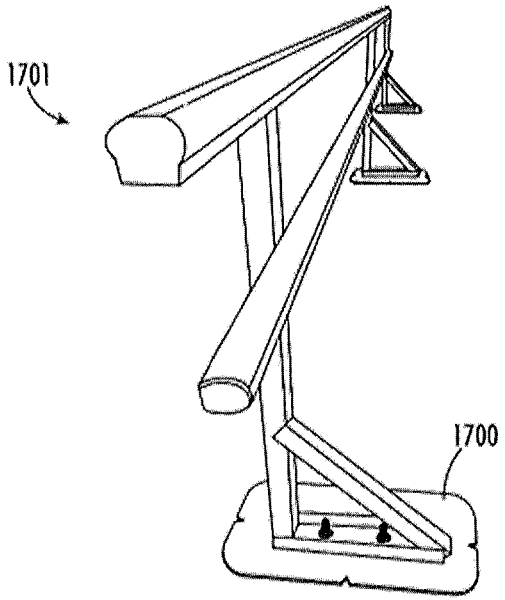
FIG. 17 is a perspective view of a plurality of support mounts used to mount a roof guardrail.

Referring now also to FIG. 17 in the drawings, a guardrail is illustrated. Guardrail 1701 is configured for attachment on a roof, or other similar structure, so as to provide a passive fall protection system. Guardrail 1701 is mounted to a structure using support mounts 1700. In this embodiment, support mounts 1700 are similar to dual anchor assembly 300.

Figure 18A:
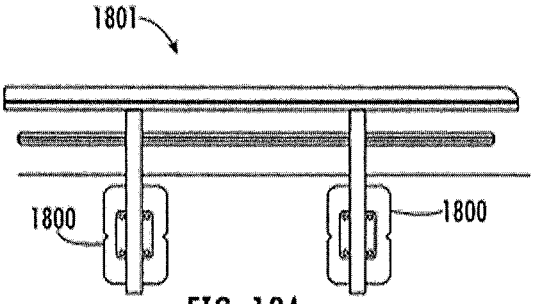
FIG. 18A is front view of a plurality of support mounts used to mount a roof guardrail on a wall.
Figure 18B:
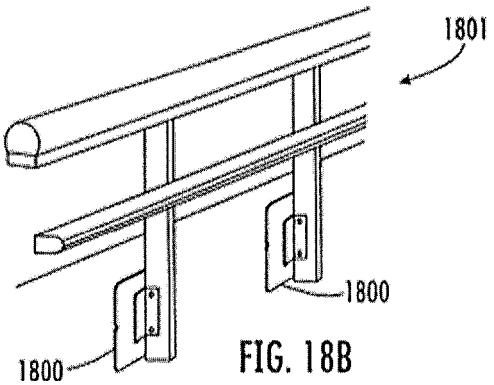
FIG. 18B is a side view of the plurality of support mounts of FIG. 18A.

Referring now also to FIGS. 18A and 18B in the drawings, an alternative embodiment of a guardrail system is illustrated. Guardrail 1801 is mounted on a wall, rather than on a rooftop surface, such as is FIG. 17. Guardrail 1801 is mounted to the wall using support mounts 1800, which are similar to dual anchor assembly 300. The guardrail system illustrated in this embodiment is particularly useful for providing passive fall protection on a roof or other structure that has a half-wall, or other shortened wall, around the perimeter.

Figure 19A:
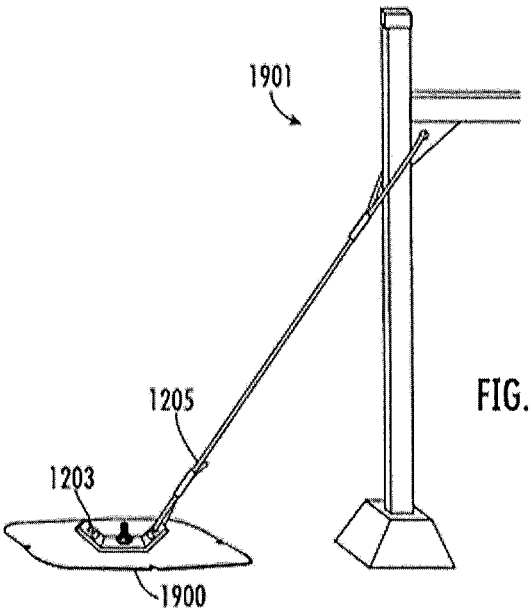
FIG. 19A is a perspective view of a support mount with a guy-wire used to secure a H-Frame.
Figure 19B:
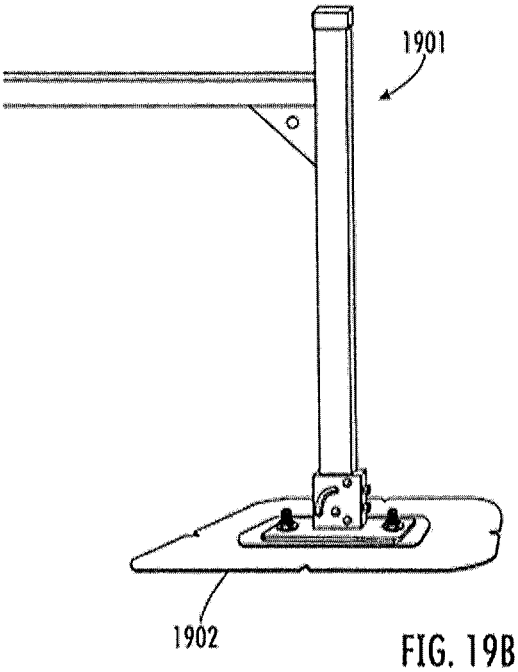
FIG. 19B is a perspective view of a support mount used to secure a H-Frame.

Referring now also to FIGS. 19A and 19B in the drawings, an H-Frame securement system is illustrated. In FIG. 19A, H-Frame 1901 is illustrated being secured to a roof, or other similar structure, using support mount 1900, bracket 1203, and guy wire 1205. Support mount 1900 is similar to single anchor assembly 200. In FIG. 19B, H-Frame 1901 is illustrated being secured to a roof, or other similar structure, using support mount 1902, which is similar to the dual anchor assembly 300.

Figure 20:
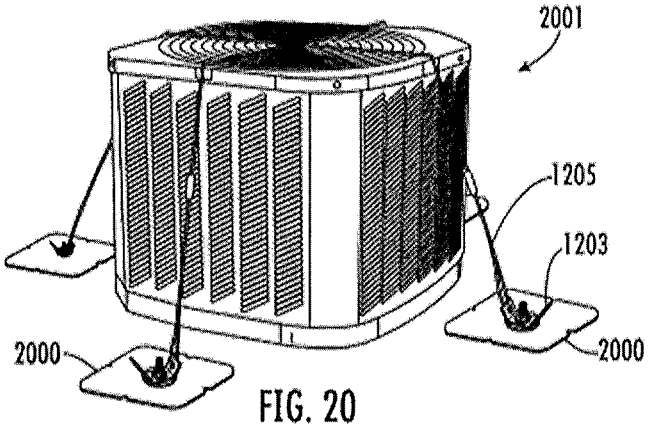
FIG. 20 is a perspective view of a plurality of support mounts used to secure a HVAC system.

Referring now also to FIG. 20 in the drawings, an HVAC tie-down securement system is illustrated. HVAC unit 2001 is secured to a roof, or other similar structure, using support mounts 2000, brackets 1203, and guy-wire 1205. In this embodiment, support mounts 2000 are similar to the single anchor assembly 200. The embodiment presented here can be installed with the system, or it can be retrofitted as needed, to protect against high wind activity or a seismic event. The embodiment presented here is particularly useful in securing any HVAC units on the rooftops of large commercial buildings, such as warehouses or shipping centers.

Figure 21:
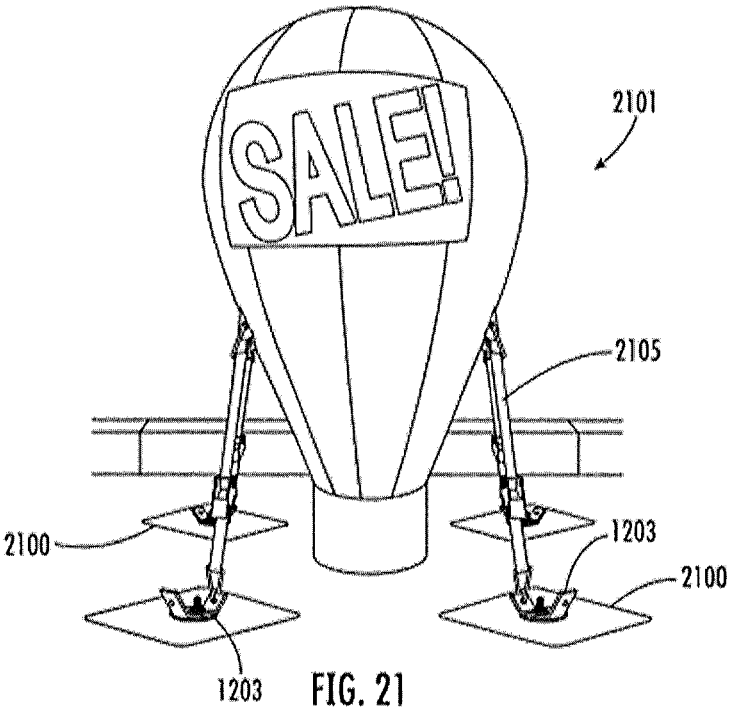
FIG. 21 is a perspective view of a plurality of support mounts used to secure an inflatable system.

Referring now also to FIG. 21 in the drawings, an inflatable securement system is illustrated. Inflatable system 2101 is secured to a roof, or other similar structure, using support mounts 2100, brackets 1203, and fastening straps 2105. In this embodiment, support mounts 2100 are similar to single anchor assembly 200. It should be appreciated that inflatable system 2101 is exemplary, and that other inflatable systems can be secured using the support mounts of the present embodiment.

Figure 22:
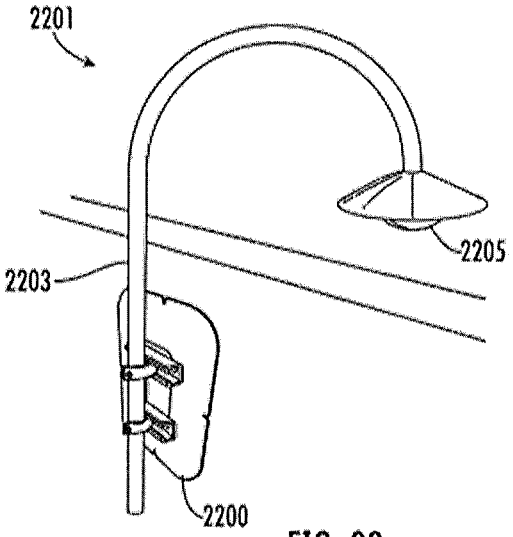
FIG. 22 is a perspective view of a support mount used to mount an exterior light.

Referring now also to FIG. 22 in the drawings, an exterior light mount system is illustrated. Exterior light 2201 includes light support 2203 and light 2205. Exterior light 2201 is secured to an exterior surface using support mount 2200. In this embodiment, support mount 2200 is similar to dual anchor assembly 300. It should be appreciated that this embodiment is exemplary, and other light variations and configurations could be used using the support mounts of this embodiment.

Figure 23A:
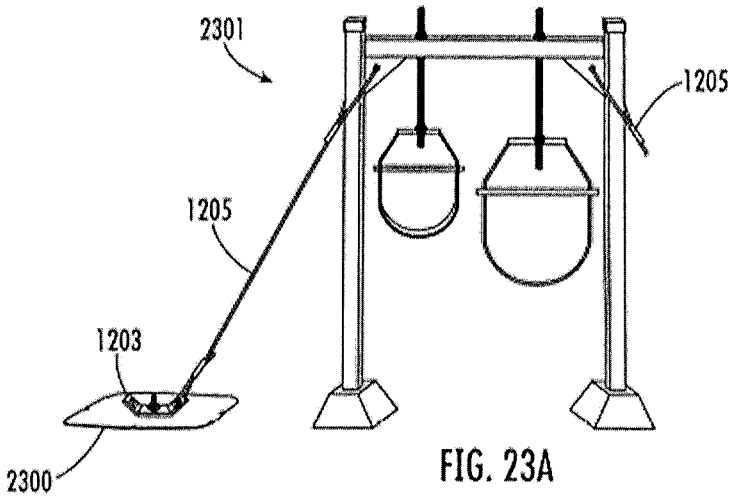
FIG. 23A is a perspective view of a support mount with a guy-wire used to secure a M.E.P. Frame.
Figure 23B:
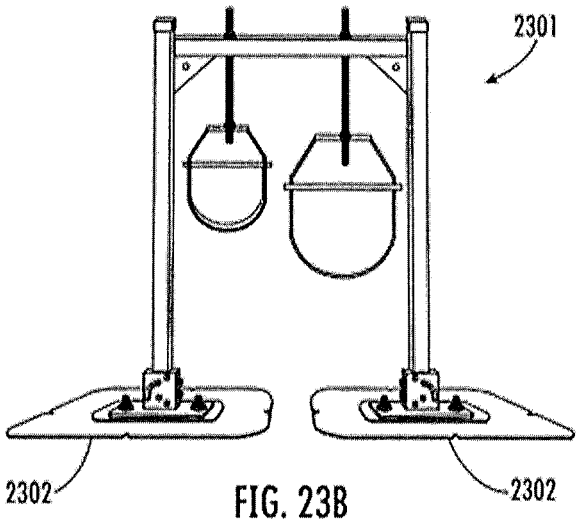
FIG. 23B is a perspective view of a plurality of support mounts used to secure a M.E.P. Frame.

Referring now also to FIGS. 23A and 23B in the drawings, a frame securement system is illustrated. In FIG. 23A, frame securement system 2301 is secured to a roof, or other similar structure, using support mount 2300, bracket 1203, and guy wire 1205. In this embodiment, support mount 2300 is similar to the single anchor assembly 200. In FIG. 23B, frame securement system 2301 is secured to a roof, or other similar, structure, using support mounts 2302. In this embodiment, support mounts 2302 are similar to the dual anchor assembly 300. The embodiment presented here is particularly useful in the securement of frames that are specialized for mechanical, electrical, and plumbing needs.

Figure 24A:
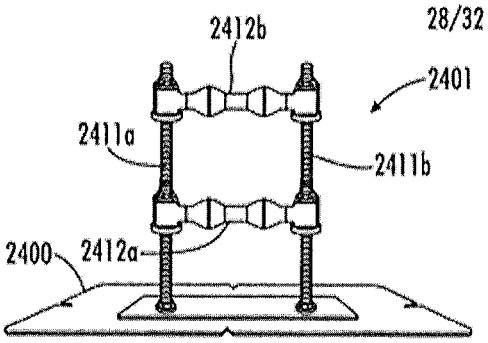
FIG. 24A is a side view of a support mount used to secure a pipe system.

Referring now also to FIGS. 24A-24E in the drawings, various embodiments of a pipe securement system are illustrated. In FIG. 24A, pipe securement system 2401 includes left support portion 2411*a*, right support portion 2411*b*, with rollers 2412*a* and 2412*b* extending between support portions 2411*a*-2411*b*. Pipe securement system 2401 is secured to a roof, or other similar structure, using support mount 2400, which is similar to the dual anchor system 300. The embodiment illustrated in FIG. 24A allows for plumbing or conduit systems to be held on or in between the rollers 2412*a*-2412*b*.

Figure 24B:
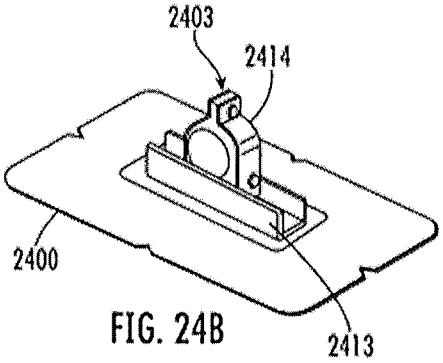
FIG. 24B is a perspective view of a support mount used to secure a pipe system.

FIG. 24B illustrates an alternative embodiment of a pipe securement system. Pipe securement system 2403 includes bracket 2413, which is configured to secure pipe holder 2414 in place. Pipe holder 2414 has two opposing sides which, together, encapsulate a diameter of a pipe. Pipe securement system 2403 is secured to a roof, or other similar structure, using support mount 2400.

Figure 24C:
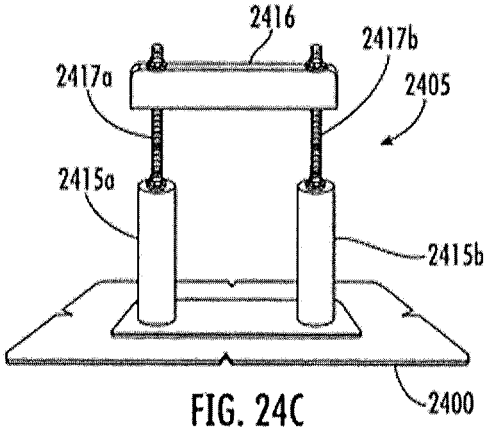
FIG. 24C is a side view of a support mount used to secure a pipe system.

FIG. 24C illustrates another alternative embodiment of a pipe securement system, wherein pipe securement system 2405 includes a left support portion and a right support portion, similar to the embodiment in FIG. 24A; however, the embodiment of FIG. 24C has a lower left support portion 2415*a* and upper left support portion 2417*a* making up the left support portion, and a lower right support portion 2415*b* and upper right support portion 2417*b* making up the right support portion. A bracket 2416 is connected to each support portion and is primarily disposed horizontally between the support portions. Pipe securement system 2405 is preferably secured to a roof, or other similar structure, using support mount 2400.

Figure 24D:
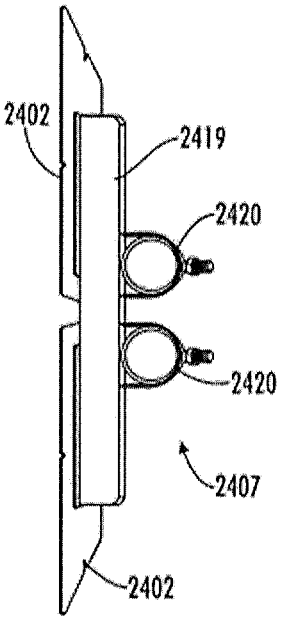
FIG. 24D is a side view of a plurality of support mounts used to secure a pipe system.

FIG. 24D illustrates a pipe securement system that could be mounted on a rooftop, wall, or other similar surface. Pipe securement system 2407 includes a bracket 2419, attached to multiple support mounts 2402. The bracket 2419 is configured to secure multiple pipe holders 2420, such that multiple elements of a plumbing system or conduit system can be secured on a roof or wall.

Figure 24E:
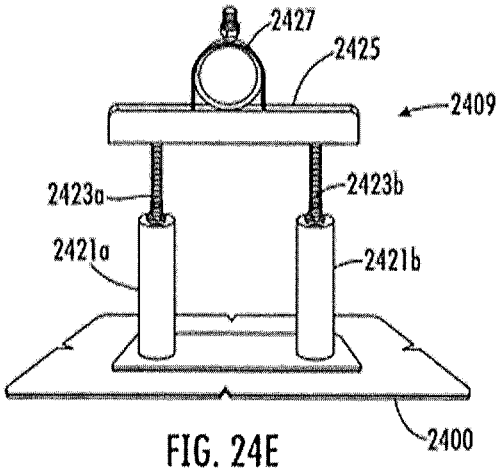
FIG. 24E is a side view of a support mount used to secure a pipe system.

FIG. 24E illustrates another alternative embodiment of a pipe securement system. Pipe securement system 2409 includes multiple two-part supports, similar to the supports of FIG. 24C. Lower left support 2421*a*, upper left support 2423*a*, lower right support 2421*b*, and upper right support 2423*b* combine to support bracket 2425, which couples to both the upper left support 2423*a* and the upper right support 2423*b*, and bracket 2425 is disposed primarily between and runs horizontally between the left and right supports. Bracket 2425 is configured to support a pipe holder 2427, which is configured to secure a pipe, such as a plumbing or conduit system.

Figure 25A:
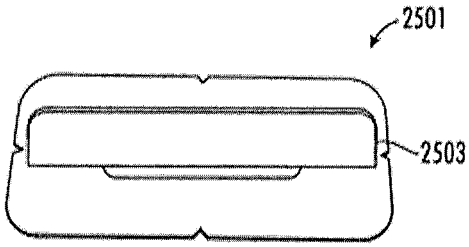
FIG. 25A is a perspective view of a support mount used in a snow fence system.
Figure 25B:
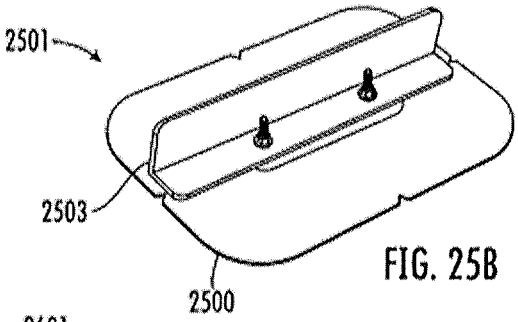
FIG. 25B is a perspective view of a support mount used in a snow fence system.
Figure 26:
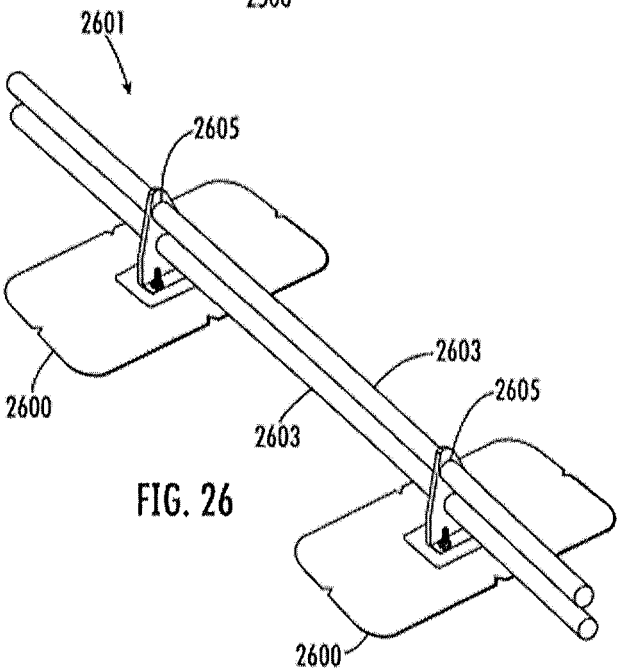
FIG. 26 is a perspective view of a plurality of support mounts used in a snow fence system.

Referring now also to FIGS. 25A, 25B, and 26 in the drawings, several embodiments of a snow fence system are illustrated. FIGS. 25A and 25B illustrate snow fence system 2501, which includes support mount 2500 and snow guard 2503. In this embodiment, support mount 2500 is similar to the dual anchor assembly 300, which allows for snow guard 2503 to be couple to the support mount by fastening snow guard 2503 to the two protrusions of support mount 2500. Snow fence system 2501 is configured such that snow is retained by the snow guard 2503 when support mount 2500 is attached to a roof, or similar structure.

FIG. 26 illustrates an alternative embodiment of the snow fence system, wherein snow fence 2601 utilizes at least one pipe 2603 to retain snow on a roof, or similar structure. Pipes 2603 are secured using brackets 2605, which are coupled to support mounts 2600, similar to the dual anchor assembly 300.

Figure 27B:
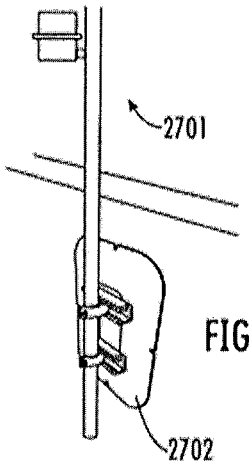
FIG. 27B is a perspective view of a support wall mount used to mount a weather station to a wall.
Figure 27A:
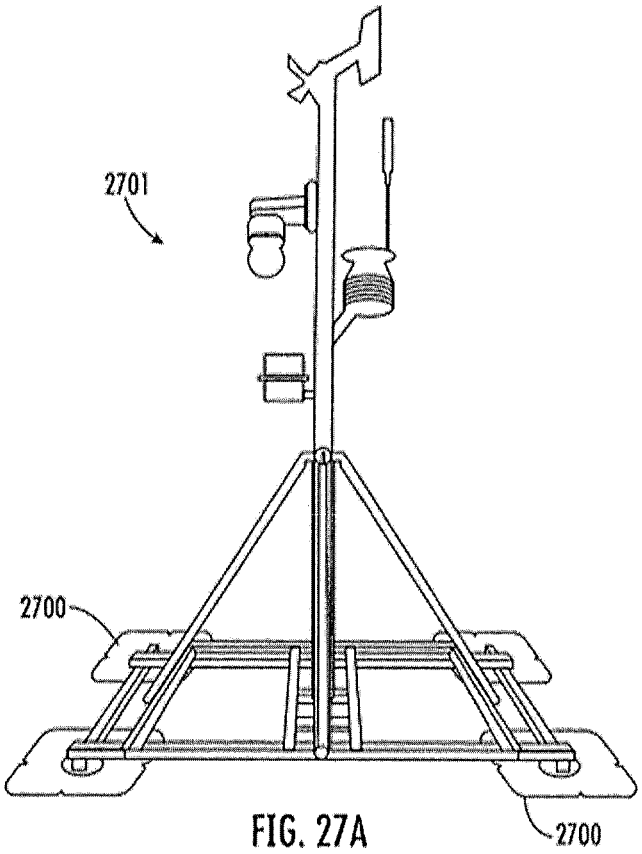
FIG. 27A is a perspective view of a plurality of support mounts used to mount a weather station.

Referring now also to FIGS. 27A and 27B in the drawings, a weather station mounting system is illustrated. FIG. 27A illustrates weather station 2701 mounted to a roof, or other similar structure, using support mounts 2700, which are similar to the single anchor assembly 200. It should be appreciated that this weather station is exemplary, and that variations of weather stations may be used with the support mounts shown in this embodiment. FIG. 27B illustrates an alternative mounting system for weather station 2701, wherein support mount 2702 is used to mount the system to a wall or similar structure. In this embodiment, support mount 2702 is similar to the dual anchor assembly 300.

Figure 28:
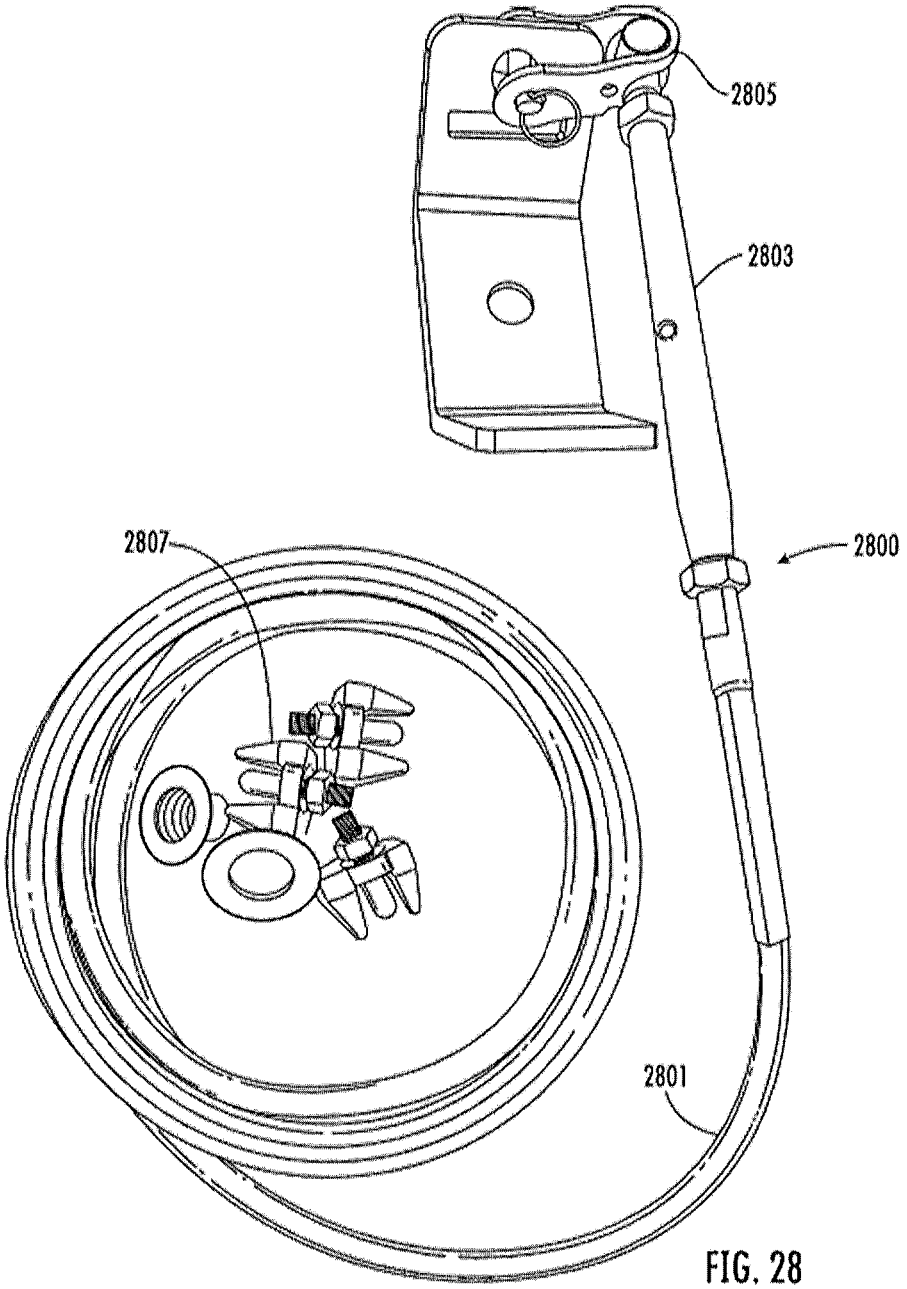
FIG. 28 is a perspective view of a customized guy wire kit utilizing the 30-30 duct tie down of FIGS. 12B and 12C.

Referring now also to FIG. 28 in the drawings, a unique and customizable tie down kit 2800 featuring the duct securement system 1201 of FIGS. 12B and 12C. Bracket 1203 is used with a guy wire 2801, a guy wire terminal end 2803, a pivoting clip 2805, and one or more retainer clips 2807. Retainer clips 2807 allow the length of guy wire to be selectively adjusted.

Figure 29:
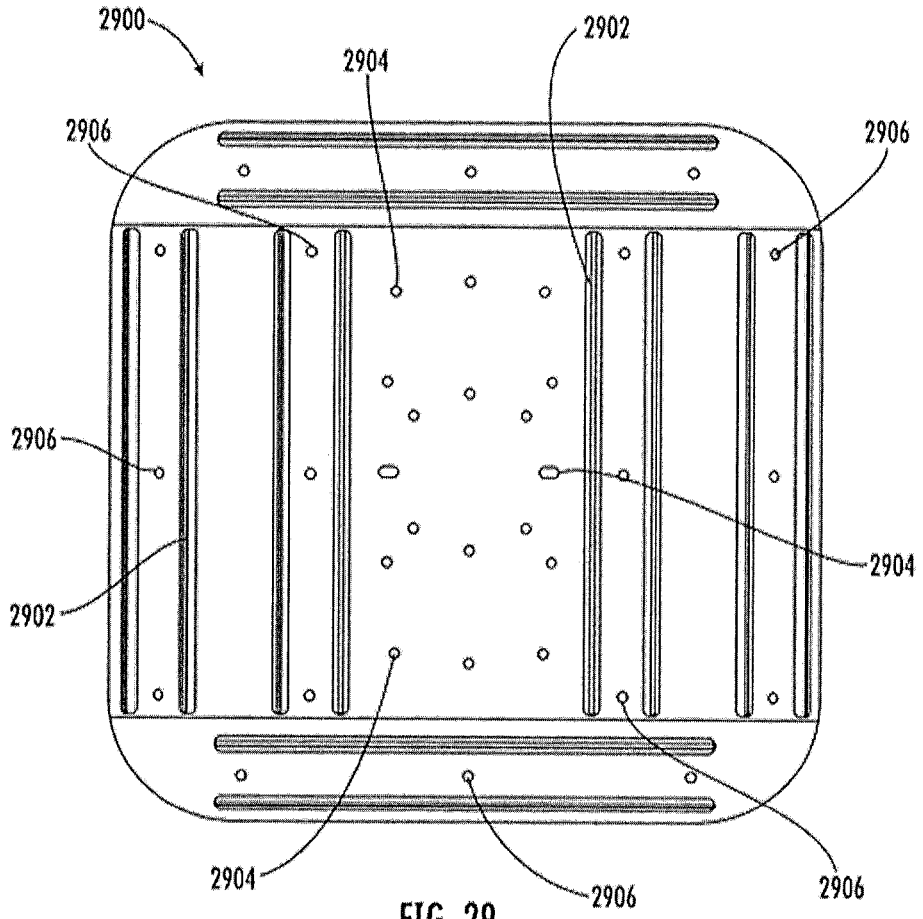
FIG. 29 is a top view of a load distribution plate.
Figure 30A:
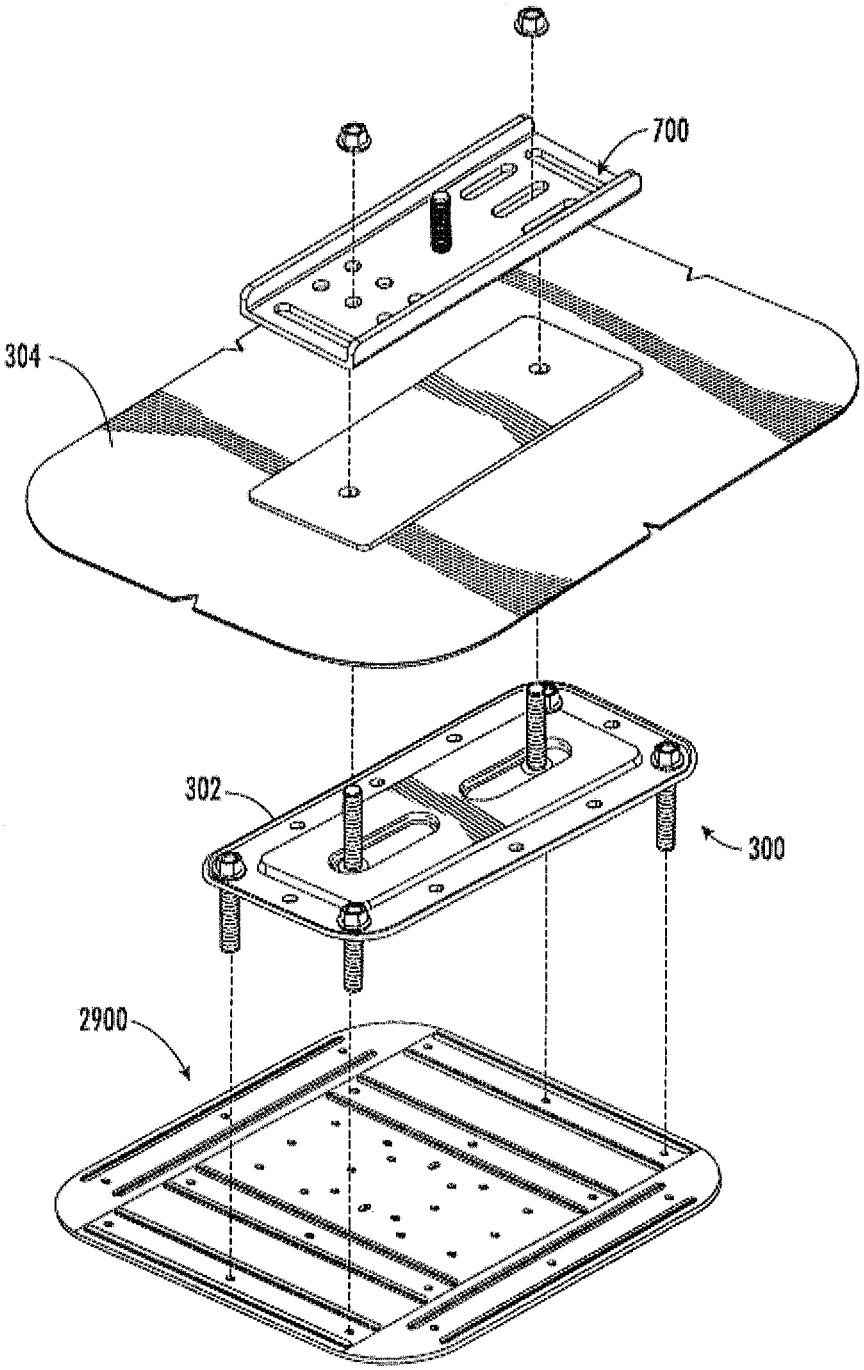
FIG. 30*a* is an exploded perspective view of a load distribution plate of FIG. 29 used with a support mount, anchor base plate, and cover membrane.
Figure 30B:
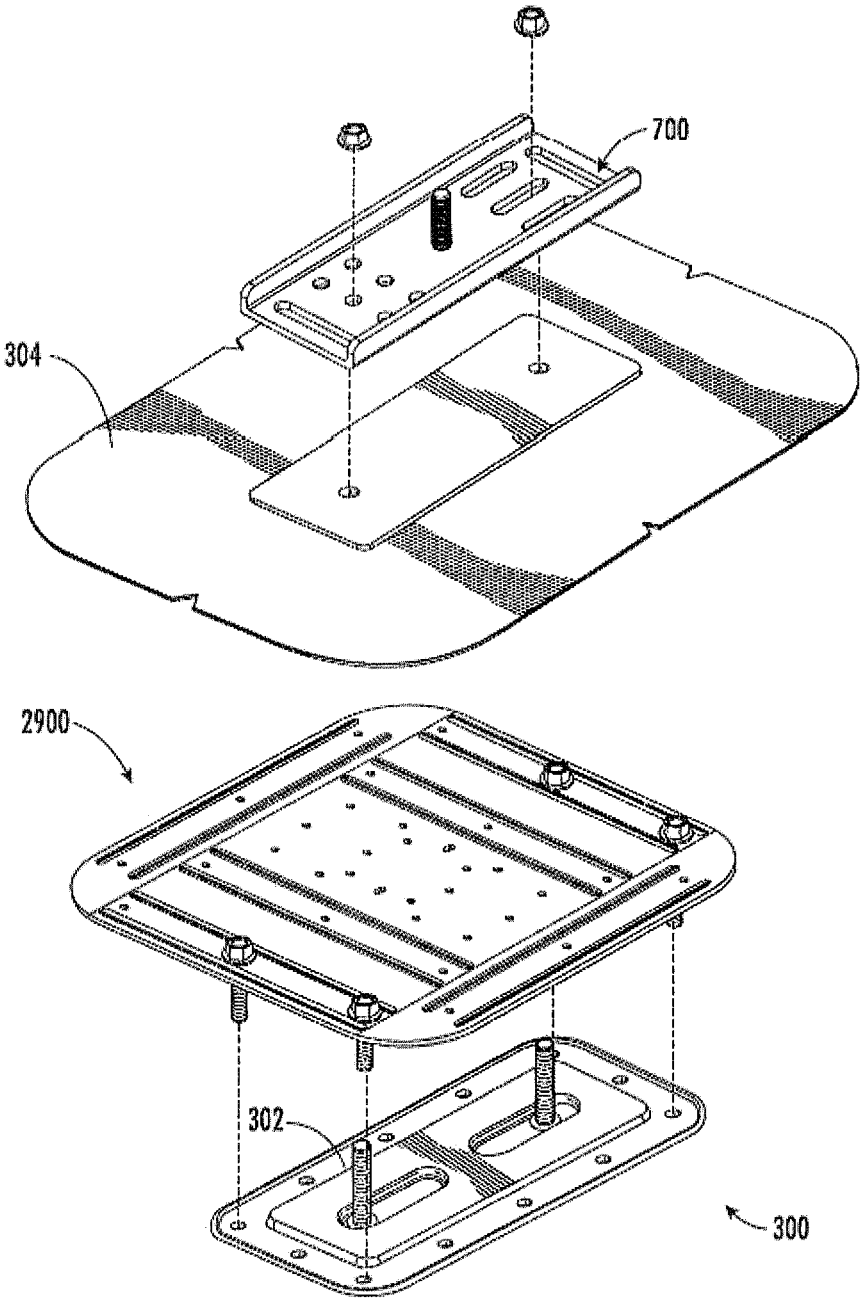
FIG. 30*b* is an exploded perspective view of a load distribution plate of FIG. 29 used with a support mount, anchor base plate, and cover membrane.

Referring now also to FIG. 29, FIG. 30*a*, and FIG. 30*b* in the drawings, a load distribution plate is illustrated. Load plate 2900 includes a plurality of ribs 2902, a plurality of interior apertures 2904, and a plurality of exterior apertures 2906. Ribs 2902 and exterior apertures 2906 are preferably arranged in the configuration shown in FIG. 29 to increase rigidity of load plate 2900. Interior apertures 2904 are preferably configured in a manner so as to allow load plate 2900 to be used with a variety of the systems described above, such as with base plate 302 of the previous figures. While the load plate 2900 preferably has the ribs 2902 and apertures 2904/2906 configured as shown in FIG. 29, it should be appreciated that other configurations can be used while maintaining the same functionality. For example, the number, size, shape, and layout of the ribs 2902 and apertures 2904/2906 may be different if it is desired to only be compatible with an individual system, or if the rigidity of the structure needs to change. Under the preferred embodiment, load plate 2900 is place between a roof or other structure and the base plate, so as to provide a load bearing support, rather than have the load of the structure entirely weighing on the bracket system. It should be appreciated that the load plate may vary in size, shape, or configuration while maintaining the desired functionality of the present invention. For example, the load plate could include fewer or additional ribs and apertures, or the load plate could be shaped differently around the exterior edges. Additionally, it should be appreciated that similar load distribution plates can be used in different positions other than being placed between a roof and a base plate. For example, the base plate could be placed between the roof and the load distribution plate.

While the foregoing figures and descriptions disclose functions of the support mounts using either single or dual anchor assemblies, it should be appreciated that the different support mounts and brackets can be substituted into other embodiments, depending on the desired configuration of the system. Additionally, it should be appreciated that the example systems provided in the foregoing illustrations and descriptions are exemplary, and in no way are meant to limit the functional applications of the support mounts and bracket systems claimed in this application.

It is apparent that a system and method with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A system for mounting objects to a roof, the system comprising:

a strut mount comprising:

a base plate having a plurality of apertures passing therethrough, the plurality of apertures having at least two different shapes, such that various coupling types may be used;

a mount channel extending up from the base plate, the mount channel having one or more apertures passing therethrough;

wherein the mount channel is configured as a c-channel having a base portion and two side portions, with the base portion and the two side portions being generally perpendicular to the base plate, and with the base portion and each side portion being attached to the base plate along one edge of the base portion and one edge of each side portion;

wherein the mount channel is configured, such that a strut may be selectably mounted in various, non-discrete positions at any of a continuous number of angles ranging from approximately 0 degrees to 90 degrees relative to the base plate; and wherein the mount channel is further configured to have a vertical slot in the base portion, the vertical slot being configured to receive fasteners when securing the strut within the mount channel.

2. The system according to claim 1, further comprising:

one or more arcuate slots passing through the mount channel.

3. The system according to claim 2, further comprising:

a rigid strut releasably coupled to the mount channel.

4. The system according to claim 3, wherein the strut is coupled to the mount channel through both the apertures and the arcuate slots, such that the strut is angularly adjustable relative to the mount channel.

5. The system according to claim 1, wherein the object is one or more of the following:

a stair assembly;
a light assembly;
a communications device;
a camera system;
an electrical system;
a duct system;
a ventilation tower system;
a solar mounting system;
a rail system;
an advertising system;
a frame securement system;
a conduit support system; and
a snow fence system.

6. The system of claim 1, further comprising:

an anchor base assembly comprising:

an anchor plate;

at least one protrusion extending up from the anchor plate, each protrusion being configured to pass through one of the plurality of apertures in the base plate, whereby the base plate may be secured to the anchor plate; and a membrane covering the anchor plate.

7. The system according to claim 6, wherein the anchor plate has two protrusions.

8. A system for mounting objects to a roof, the system comprising:

a support mount comprising:

a base plate having a plurality of bolt holes passing therethrough;

at least one stiffener integral with the base plate for providing stiffness to the base plate;

a center protrusion extending up from the base plate; and an anchor base assembly comprising:

an anchor plate;

at least one projection extending up the from the anchor plate, the at least one projection being configured to pass through one of the bolt holes in the base plate, whereby the base plate may be secured to the anchor plate; and a membrane covering the anchor plate; and a load distribution plate disposed beneath the anchor plate, the load distribution plate being configured to receive the anchor plate and allow the anchor plate to be attached to the roof through the load distribution plate, the load distribution plate being further configured to be covered by the membrane.

9. The system of claim 8, wherein the stiffener extends longitudinally; and wherein the stiffener and the base plate have the same general length.

10. The system of claim 8, wherein the stiffener extends longitudinally along the base plate and is angled outward from the base plate.

11. The system of claim 8, wherein each projection is welded to a top surface of the anchor plate.

12. The system of claim 8, wherein the load distribution plate includes one or more stiffening ribs for providing stiffness to the load distribution plate.

13. A system for mounting objects to a structure, the system comprising:

an anchor base assembly comprising:

an anchor plate configured for attachment to the structure;

at least one projection extending up from the anchor plate; and a thermoplastic membrane covering the anchor plate; and a bracket comprising:

a center portion having a center hole, the center hole being configured to receive the at least one projection of the anchor plate, such that the bracket may be secured to the anchor plate;

at least two planar side portions on opposing ends of the center portion, the at least two planar side portions being angled upward relative to the center portion, the at least two planar side portions comprising:

at least one circular hole perpendicular to the planar side portion; and a slot;

wherein the at least two planar side portions are angled at an acute angle relative to the center portion.

14. The system of claim 13, wherein the structure is a roof.

15. The system of claim 13, wherein the structure is a wall.

16. The system of claim 13, further comprising:

at least one guy wire configured for coupling to the circular hole.

17. The system of claim 16, wherein the guy wire is adjustable in length.

18. The system of claim 13, wherein the object is one or more components of an HVAC unit.

19. The system of claim 16, wherein the guy wire extending to couple to the circular hole is at an acute angle relative to the center portion.

20. A system for mounting objects to a roof, the system comprising:

a support mount comprising:

a base plate having a plurality of bolt holes passing therethrough;

at least one stiffener integral with the base plate for providing stiffness to the base plate;

a center protrusion extending up from the base plate; and an anchor base assembly comprising:

an anchor plate;

at least one projection extending up the from the anchor plate, the at least one projection being configured to pass through one of the bolt holes in the base plate, whereby the base plate may be secured to the anchor plate; and a membrane covering the anchor plate; and a load distribution plate disposed above the anchor plate, the load distribution plate being configured to receive the anchor plate and allow the anchor plate to be attached to the roof through the load distribution plate, the load distribution plate being further configured to be covered by the membrane.

* * * * *